US005260182A

United States Patent [19]

Nagaoka et al.

[11] Patent Number: 5,260,182

[45] Date of Patent: * Nov. 9, 1993

[54] SILVER HALIDE COLOR PHOTOGRAPHIC PHOTOSENSITIVE MATERIALS

[75] Inventors: Satoshi Nagaoka; Akira Ogawa, both of Kanagawa, Japan

[73] Assignee: Fuji Photo Film Co., Ltd., Kanagawa, Japan

[ * ] Notice: The portion of the term of this patent subsequent to Mar. 16, 2010 has been disclaimed.

[21] Appl. No.: 845,038

[22] Filed: Mar. 3, 1992

[30] Foreign Application Priority Data

Mar. 6, 1991 [JP] Japan ..... 3-63696

[51] Int. Cl.[5] ..... G03C 1/08; G03C 7/26; G03C 7/32

[52] U.S. Cl. ..... 430/558; 430/957; 430/567; 430/389

[58] Field of Search ..... 430/557, 957, 567, 389

[56] References Cited

U.S. PATENT DOCUMENTS

| | | | |
|---|---|---|---|
| 4,149,886 | 4/1979 | Tanaka et al. | 430/382 |
| 4,610,958 | 9/1986 | Matsuzaka et al. | 430/569 |
| 4,818,670 | 4/1989 | Yagi et al. | 430/544 |

FOREIGN PATENT DOCUMENTS

| | | |
|---|---|---|
| 447920A1 | 9/1991 | European Pat. Off. . |
| 1204680 | 9/1970 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

The present invention relates to a silver halide color photographic photosensitive material comprising a support having thereon at least one silver halide emulsion layer, wherein a yellow dye forming coupler which is represented by formula (1) indicated below and/or a yellow dye forming coupler which can be represented by formula (2) indicated below are included in said silver halide emulsion layer, and the size distribution of the silver halide grains in said silver halide emulsion layer is mono-disperse:

(1)

(2)

wherein $X_1$ and $X_2$ each represent an alkyl gorup, an aryl group or a heterocyclic group, $X_3$ represents an organic residual group which, together with >N—, forms a nitrogen containing heterocyclic group, Y represent an aryl group or a heterocyclic group, and Z represents a group which is released when the coupler represented by formulae (1) and (2) reacts with the oxidized form of the developing agent.

21 Claims, No Drawings

SILVER HALIDE COLOR PHOTOGRAPHIC PHOTOSENSITIVE MATERIALS

FIELD OF THE INVENTION

The present invention relates to silver halide color photographic photosensitive materials and, in particular, the present invention relates to silver halide color photographic photosensitive materials which have excellent picture quality, hue and color image fastness.

BACKGROUND OF THE INVENTION

In a silver halide color photographic photosensitive material the color image is formed after exposing the material to light by the reaction between a primary aromatic amine developing agent which has been oxidized by color development and dye forming couplers (referred to hereinafter as couplers).

In general, color reproduction by means of the subtractive method is used, and in this method, yellow, magenta and cyan images which are of the complimentary colors, are formed to reproduce blue, green and red. Acylacetamide couplers are generally used for the yellow dye forming couplers (referred to hereinafter as yellow couplers) for forming the yellow dye image, 5-pyrazolone couplers are generally used as magenta couplers for forming the magenta image and phenol couplers and naphthol couplers are generally used as cyan couplers for forming the cyan image.

The yellow, magenta and cyan dyes obtained from these couplers are generally formed in a silver halide layer which is color sensitive to radiation which has a complimentary color relationship with the radiation which is absorbed by the dye, or in a layer adjacent thereto.

The acylacetamide couplers as typified by the benzoylacetanilide couplers and the pivaloylacetanilide couplers have generally been used in the past as yellow couplers, and in particular for color image forming purposes. The former couplers generally have a high coupling activity with the oxidized form of primary aromatic amine developing agents during development. The absorption coefficient of the yellow dyes which are formed are large, so they are used mainly in camera color photosensitive materials, and in particular in color negative films, where high speed is required. The latter couplers are such that the spectral absorption characteristics and fastness of the yellow dyes are excellent and so they are used mainly in color papers and color reversal films.

However, it cannot be said that graininess is completely satisfactory.

SUMMARY OF THE INVENTION

Hence, one object of the present invention is firstly to provide color photographic photosensitive materials which have improved graininess.

Secondly, another object of the present invention is to provide color photographic photosensitive materials which have excellent spectral absorption characteristics and excellent color image storage properties.

These objects have been resolved by the means indicated below.

That is to say, the present invention relates to a silver halide color photographic photosensitive material comprising a support having thereon at least one silver halide emulsion layer, wherein at least one type of yellow dye forming coupler which can be represented by formula (1) indicated below and/or at least one type of yellow dye forming coupler which can be represented by formula (2) indicated below are included in said silver halide emulsion layer, and the size distribution of the silver halide grains in said silver halide emulsion layer is mono-disperse:

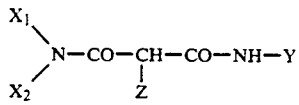

(1)

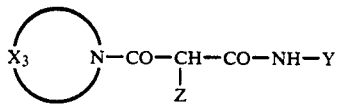

(2)

wherein in these formulae, $X_1$ and $X_2$ each represent an alkyl group, an aryl group or a heterocyclic group, $X_3$ represents an organic residual group which, together with >N—, forms a nitrogen containing heterocyclic group, Y represents an aryl group or a heterocyclic group, and Z represents a group which is released when the coupler represented by said formulae (1) and (2) reacts with the oxidized form of the developing agent.

DETAILED DESCRIPTION OF THE INVENTION

The couplers represented by formulae (1) and (2) are described in detail hereinbelow.

When $X_1$ and $X_2$ represent alkyl groups, these groups are linear chain, branched, cyclic, saturated, unsaturated, substituted or unsubstituted alkyl groups which have from 1 to 30, and preferably from 1 to 20, carbon atoms. Methyl, ethyl, propyl, butyl, cyclopropyl, allyl, tert-octyl, iso-butyl, dodecyl and 2-hexyldecyl can be cited as examples of alkyl groups.

When $X_1$ and $X_2$ represent heterccyclic groups these groups are from three to twelve, and preferably five- or six-membered, saturated or unsaturated, substituted or unsubstituted, single ring or condensed ring heterocyclic groups which contain at least one nitrogen atom, oxygen atom or sulfur atom, for example, as a hetero atom, and which have from 1 to 20, and preferably from 1 to 10, carbon atoms. 3-Pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-3-yl and pyranyl, for example, can be cited as examples of heterocyclic groups.

When $X_1$ and $X_2$ represent aryl groups, these groups are substituted or unsubstituted aryl groups which have from 6 to 20, and preferably from 6 to 10, carbon atoms.

When $X_3$ represents a nitrogen containing heterocyclic group which is formed together with >N—, the heterocyclic group is a from three- to twelve-, and preferably five- or six-membered, substituted or unsubstituted, saturated or unsaturated, single ring or condensed ring heterocyclic group which may contain oxygen or sulfur atoms, for example, as well as nitrogen atoms, as hetero atoms, and which has from 1 to 20, and preferably from 1 to 15, carbon atoms. Pyrrolidino, piperidino, morpholino, 1-piperazinyl, 1-indolinyl, 1,2,3,4-tetrahydoquinolin-1-yl, 1-imidazolidinyl, 1-pyrazolyl, 1-pyrrolinyl, 1-pyrazolidinyl, 2,3-dihydro-1-imidazolyl, 2-isoindolinyl, 1-indolyl, 1-pyrrolyl, 4-thiazin-S,S-dioxo-4-yl and benzoxazin-4-yl can be cited as examples of this heterocyclic group.

When the aforementioned $X_1$ and $X_2$ represent alkyl groups, aryl groups or heterocyclic groups which have substituent groups, and when $X_3$ is such that the nitrogen containing heterocyclic group which is formed together with >N— has substituent groups, the substituent groups may be, for example, those indicated below. Halogen atoms (for example, fluorine, chlorine), alkoxycarbonyl groups (which have from 2 to 30, and preferably from 2 to 20 carbon atoms, for example, methoxycarbonyl, dodecyloxycarbonyl, hexadecyloxycarbonyl), acylamino groups (which have from 2 to 30, and preferably from 2 to 20 carbon atoms, for example, acetamido, tetradecanamido, 2-(2,4-di-tert-amylphenoxy) butanamido, benzamido), sulfonamido groups (which have from 1 to 30, and preferably from 1 to 20 carbon atoms, for example, methanesulfonamido, dodecanesulfonamido, hexadecylsulfonamido, benzenesulfonamido), carbamoyl groups (which have from 1 to 30, and preferably from 1 to 20 carbon atoms, for example, N-butylcarbamoyl, N,N-diethylcarbamoyl), N-sulfonylcarbamoyl groups (which have from 1 to 30, and preferably from 1 to 20 carbon atoms, for example, N-mesylcarbamoyl, N-dodecylsulfonylcarbamoyl), sulfamoyl groups (which have from 1 to 30, and preferably from 1 to 20 carbon atoms, for example, N-butylsulfamoyl, N-dodecylsulfamoyl, N-hexadecylsulfamoyl, N-3-(2,4-di-tert-amylphenoxy)butyl-sulfamoyl, N,N-diethylsulfamoyl), alkoxy groups (which have from 1 to 30, and preferably from 1 to 20 carbon atoms, for example, methoxy, hexadecyloxy, isopropoxy), aryloxy groups (which have from 6 to 20, and preferably from 6 to 10 carbon atoms, for example, phenoxy, 4-methoxyphenoxy, 3-tert-butyl-4-hydroxyphenoxy, naphthoxy), aryloxycarbonyl groups (which have from 7 to 21, and preferably from 7 to 11 carbon atoms, for example phenoxycarbonyl), N-acylsulfamoyl groups (which have from 2 to 30, and preferably from 2 to 20 carbon atoms, for example, N-propanoylsulfamoyl, N-tetradecanoylsulfamoyl), sulfonyl groups (which have from 1 to 30, and preferably from 1 to 20 carbon atoms, for example, methanesulfonyl, octanesulfonyl, 4-hydroxyphenylsulfonyl, dodecanesulfonyl), alkoxycarbonylamino groups (which have from 1 to 30, and preferably from 1 to 20 carbon atoms, for example, ethoxycarbonylamino), cyano group, nitro group, carboxyl group, hydroxyl group, sulfo group, alkylthio groups (which have from 1 to 30, and preferably from 1 to 20 carbon atoms, for example methylthio, dodecylthio, dodecylcarbamoylmethylthio), ureido groups (which have from 1 to 30, and preferably from 1 to 20 carbon atoms, for example, N-phenylureido, N-hexadecylureido), aryl groups (which have from 6 to 20, and preferably from 6 to 10 carbon atoms, for example, phenyl, naphthyl, 4-methoxyphenyl), heterocyclic groups (being from three to twelve, and preferably five or six, membered, single ring or condensed ring heterocyclic groups which have from 1 to 20, and preferably from 1 to 10 carbon atoms and which have at least one nitrogen atom, oxygen atom or sulfur atom, for example, as a hetero atom, for example, 2-pyridyl, 3-pyrazolyl, 1-pyrrolyl, 2,4-dioxo-1,3-imidazolidin-1-yl, 2-benzoxazolyl, morpholino, indolyl), alkyl groups (linear chain, branched, cyclic, saturated or unsaturated alkyl groups which have from 1 to 30, and preferably from 1 to 20 carbon atoms, for example, methyl, ethyl, isopropyl, cyclopropyl, tert-pentyl, tert-octyl, cyclopentyl, tert-butyl, sec-butyl, dodecyl, 2-hexyldecyl), acyl groups (which have from 1 to 30, and preferably from 2 to 20 carbon atoms, for example, acetyl, benzoyl), acyloxy groups (which have from 2 to 30, and preferably from 2 to 20 carbon atoms, for example, propanoyloxy, tetradecanoyloxy), arylthio groups (which have from 6 to 20, and preferably from 6 to 10 carbon atoms, for example, phenylthio, naphthylthio), sulfamoylamino groups (which have from 0 to 30, and preferably from 0 to 20 carbon atoms, for example, N-butylsulfamoylamino, N-dodecylsulfamoylamino, N-phenylsulfamoylamino) and N-sulfonylsulfamoyl groups (which have from 1 to 30, and preferably from 1 to 20 carbon atoms, for example, N-mesylsulfamoyl, N-ethane-sulfonylsulfamoyl, N-dodecanesulfonylsulfamoyl, N-hexadecanesulfonylsulfamoyl). The substituent groups may have further substituents. Examples of these substituent groups include those cited above.

From among the groups mentioned above, the alkoxy groups, halogen atoms, alkoxycarbonyl groups, acyloxy groups, acylamino groups, sulfonyl groups, carbamoyl groups, sulfamoyl groups, sulfonamido groups, nitro group, alkyl groups and aryl groups are preferred as substituent groups.

When Y in formulae (1) and (2) represents an aryl group it is a substituted or unsubstituted aryl group which has from 6 to 20, and preferably from 6 to 10 carbon atoms. For example, it is typically a phenyl group or a naphthyl group.

When Y in formulae (1) and (2) is a heterocyclic group, it has the same meaning as that described when $X_1$ or $X_2$ represents a heterocyclic group.

When the aforementioned Y represents a substituted aryl group or a substituted heterocyclic group, the substituent groups described as examples when the aforementioned $X_1$ has substituent groups, for example, can be cited as examples of these substituent groups. Halogen atoms, alkoxycarbonyl groups, sulfamoyl groups, carbamoyl groups, sulfonyl groups, N-sulfonylsulfamoyl groups, N-acylsulfamoyl groups, alkoxy groups, acylamino groups, N-sulfonylcarbamoyl groups, sulfonamido groups and alkyl groups are preferred as examples of one of the substituent groups for Y.

A phenyl group which has at least one substituent group in an ortho position is especially desirable for Y.

Any of the conventionally known coupling releasing groups may be used for the group represented by Z in formulae (1) and (2). Nitrogen containing heterocyclic groups which are bonded to the coupling position with a nitrogen atom, aryloxy groups, arylthio groups, heterocyclic oxy groups, heterocyclic thio groups, acyloxy groups, carbamoyloxy groups, alkylthio groups or halogen atoms are preferred for Z.

These coupling releasing groups may be non-photographically useful groups, or photographically useful groups or precursors thereof (for example development inhibitors, development accelerators, desilvering promotors, fogging agents, dyes, film hardening agents, couplers, scavengers for the oxidation product of the developing agent, fluorescent dyes, developing agents or electron transfer agents).

The photographically useful groups known in the art are useful when Z is a photographically useful group. For example, use can be made of the photographically useful groups or leaving groups for releasing these groups (for example, timing groups) disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, and European Patents laid open 193,389A, 348,139A and 272,573A.

When Z is a nitrogen containing heterocyclic group which is bonded with a nitrogen atom to the coupling position it is preferably a five or six membered, substituted or unsubstituted, saturated or unsaturated, single ring or condensed ring heterocyclic group which has from 1 to 15, and preferably from 1 to 10 carbon atoms. Oxygen atoms and sulfur atoms may be included as hetero atoms, as well as nitrogen atoms. 1-Pyrazolyl, 1-imidazolyl, pyrrolino, 1,2,4-triazol-2-yl, 1,2,3-triazol-1-yl, benzotriazolyl, benzimidazolyl, imidazolidin-2,4-dione-3-yl, oxazolidin-2,4-dione-3-yl, 1,2,4-triaoolidin-3,5-dione-4-yl, imidazolidin-2,4,5-trione-3-yl, 2-imidazolin-1-yl, 3,5-dioxomorpholino and 1-indazolyl are preferred examples of the heterocyclic groups. When these heterocyclic groups have substituent groups, the substituent groups cited as examples of substituent groups when the aforementioned group represented by $X_1$ had substituent groups can be cited for the substituent groups. Preferred examples of the substituent groups are such that one of the substituent groups of an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group or a sulfonyl group.

When Z represents an aromatic oxy group it is preferably a substituted or unsubstituted aromatic oxy group which has from 6 to 10 carbon atoms. It is most desirably a substituted or unsubstituted phenoxy group. When it has substituent groups, those cited as substituent groups for the aforementioned group represented by $X_1$ can be cited as examples of the substituent groups. From among these groups, those cases in which at least one substituent group is an electron withdrawing substituent group are preferred, and sulfonyl groups, alkoxycarbonyl groups, sulfamoyl groups, halogen atoms, carbamoyl groups, nitro group, cyano group and acyl groups can be cited as examples of such groups.

When Z represents an aromatic thio group, it is preferably a substituted or unsubstituted aromatic thio group which has from 6 to 10 carbon atoms. It is most desirably a substituted or unsubstituted phenylthio group. When it has substituent groups, those cited as substituent groups for the aforementioned group represented by $X_1$ can be cited as examples of the substituent groups. From among these groups those cases in which at least one substituent gorup is an alkyl group, an alkoxy group, a sulfonyl group, an alkoxycarbonyl group, a sulfamoyl group, a halogen atom, a carbamoyl group or a nitro group are preferred.

When Z represents a heterocyclic oxy group, it is a three- to twelve-, and preferably five- or six-membered, substituted or unsubstituted, saturated or unsaturated, single ring or condensed ring heterocyclic group which has from 1 to 20, and preferably from 1 to 10 carbon atoms and which contains at least one nitrogen atom, oxygen atom or sulfur atom, for example, as a hetero atom. Pyridyloxy, pyrazolyloxy or furyloxy can be cited as examples of heterocyclic oxy groups. When it has substituent groups, those cited as substituent groups for the aforementioned group represented by $X_1$ can be cited as examples of the substituent groups. From among these grups, those cases in which at least one substituent group is an alkyl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group are preferred.

When Z represents a heterocyclic thio group it is a three- to twelve-, and preferably five- or six-membered, substituted or unsubstituted, saturated or unsaturated, single ring or condensed ring heterocyclic group which has from 1 to 20, and preferably from 1 to 10, carbon atoms and which contains at least one nitrogen atom, oxygen atom or sulfur atom, for example, as a hetero atom. A tetrazolylthio group, a 1,3,4-thiadiazolylthio group, a 1,3,4-oxadiazolylthio group, a 1,3,4-triazolylthio group, a benzimidazolythio group, a benzothiazolylthio group and a 2-pyridylthio group can be cited as examples of heterocyclic thio groups. When it has substituent groups, those cited as substituent groups for the aforementioned group represented by $X_1$ can be cited as examples of the substituent groups. From among these groups, those cases in which at least one substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group or a sulfonyl group are preferred.

When Z represents an acyloxy group, it is preferably a single ring or condensed ring, substituted or unsubstituted aromatic acyloxy group which has from 6 to 10 carbon atoms or a substituted or unsubstituted aliphatic acyloxy group which has from 2 to 30, and preferably from 2 to 20 carbon atoms. When these groups have substituent groups, those cited as substituent groups for the aforementioned group represented by $X_1$ can be cited as examples of the substituent groups.

When Z represents a carbamoyloxy group, it is preferably a single ring or condensed ring, substituted or unsubstituted aromatic acyloxy group which has from 6 to 10 carbon atoms or a substituted or unsubstituted aliphatic acyloxy group which has from 2 to 30, and preferably from 2 to 20 carbon atoms. N,N-Diethylcarbamoyloxy, N-phenylcarbamoyloxy, 1-imidazolylcarbonyloxy and 1-pyrrolocarbonyloxy can be cited as examples. When these groups have substituent groups, those cited as substituent groups for the aforementioned group represented by $X_1$ can be cited as examples of the substituent groups.

When Z represents an alkylthio group, it is a linear chain, branched, cyclic, saturated, unsaturated, substituted or unsubstituted alkylthio group which has from 1 to 30, and preferably from 1 to 20 carbon atoms. When these groups have substituent groups, those cited as substituent groups for the aforementioned group represented by $X_1$ can be cited as examples of the substituent groups.

The most desirable range of the couplers represented by formulae (1) and (2) is described below.

The group represented by $X_1$ in formula (1) is preferably an alkyl group. Most desirably it is an alkyl group which has from 1 to 10 carbon atoms.

The group represented by Y in formulae (1) and (2) is preferably an aromatic group. Most desirably it is a phenyl group which has at least one substituent group in the ortho-position. The description of the substituent groups is the same as that for the substituent groups when the aforementioned Y is an aromatic group. The preferred substituent groups are also the same.

The group represented by Z in formulae (1) and (2) is preferably a five or six membered nitrogen containing heterocyclic group which is bonded to the coupling position by a nitrogen atom, an aromatic oxy group, a five or six membered heterocyclic oxy group or a five or six membered heterocyclic thio group.

The preferred couplers of formulae (1) and (2) can be represented by the formulae (3), (4) or (5) below:

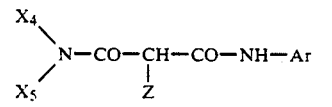
(3)

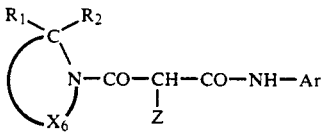
(4)

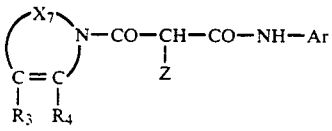
(5)

In these formulae, Z has the same meaning as described in connection with formula (1), $X_4$ represents alkyl group, $X_5$ represents an alkyl group or an aromatic group, Ar represents a phenyl group which has at least one substituent group in an ortho position, $X_6$ represents an organic residual group which, together with $-C(R_1R_2)-N<$, forms a nitrogen containing heterocyclic group (single or condensed ring), $X_7$ represents an organic residual group which, together with $-C(R_3)=C(R_4)-N<$, forms a nitrogen containing heterocyclic group (single or condensed ring), and $R_1$, $R_2$, $R_3$ and $R_4$ represent hydrogen atoms or substituent groups.

The detailed description and preferred scope of the groups represented by $X_4$ to $X_7$, Ar and Z in formulae (3) to (5) is the same as that described in the corresponding scope of the description of formulae (1) and (2). When $R_1$ to $R_4$ represent substituent groups, these are the substituent groups described earlier as substituent groups for $X_1$.

The couplers represented by formulae (4) or (5) are especially desirable from among the couplers described above.

The couplers represented by formulae (1) to (5) may form dimers or larger oligomers by bonding via bivalent groups or groups of higher valency among the groups represented by $X_1$ to $X_7$, Y, Ar, $R_1$ to $R_4$ and Z. In this case, the groups may be outside the specified range for the number of carbon atoms shown for each of the aforementioned substituent groups.

The couplers represented by formulae (1) to (5) are preferably couplers of the type which are nondiffusible. Such nondiffusible couplers are couplers which have a group which has a sufficiently high molecular weight to render the molecule immobile in the layer to which it is added. Generally, alkyl groups which have overall from 8 to 30, and preferably from 10 to 20 carbon atoms, or aryl groups which have substituent groups which have overall from 4 to 20 carbon atoms are used. Any of these groups which render the coupler nondiffusible may be substituted into the molecule, and a plurality of such groups may be used.

Actual examples of yellow couplers represented by formulae (1) to (5) are indicated below, but the invention is not limited by these examples.

Y-1

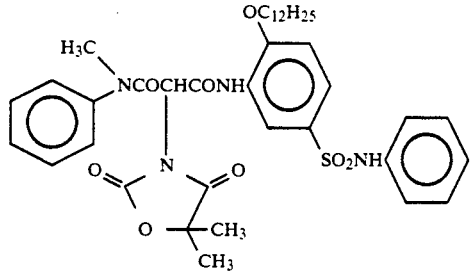

Y-2

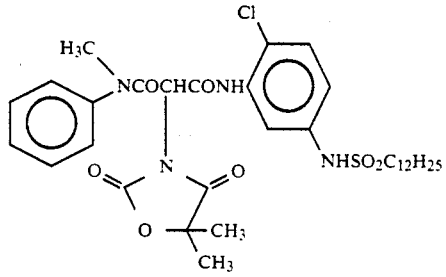

Y-3

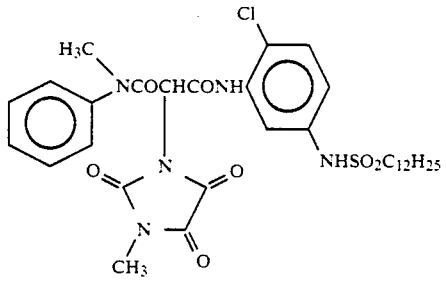

Y-4

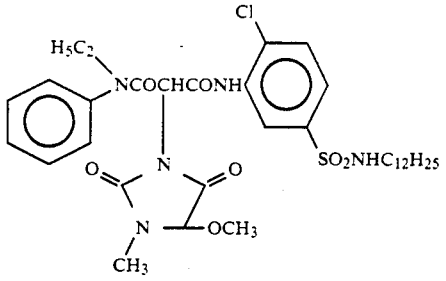

Y-5

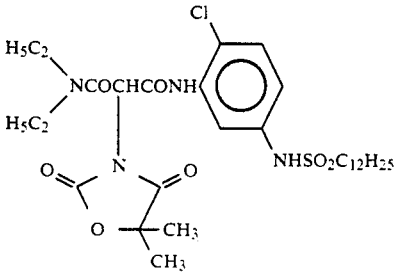

-continued
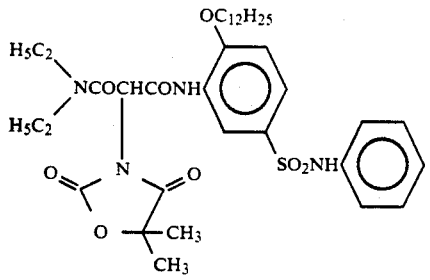
Y-6
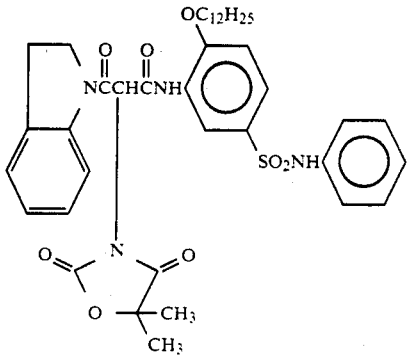
Y-7
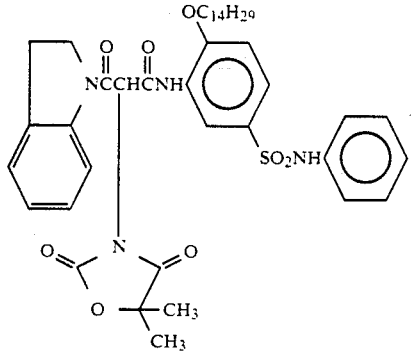
Y-8
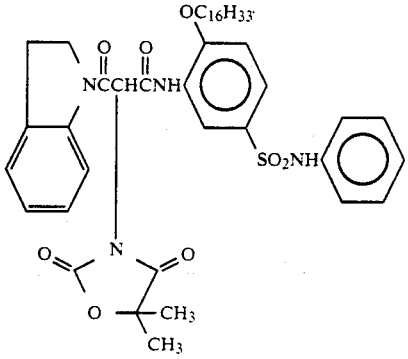
Y-9
-continued
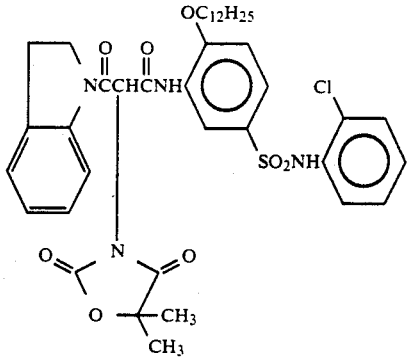
Y-10
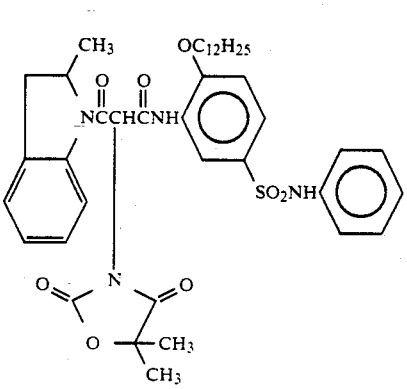
Y-11
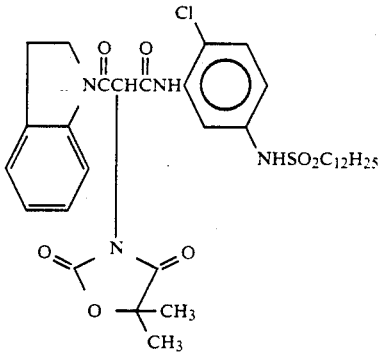
Y-12
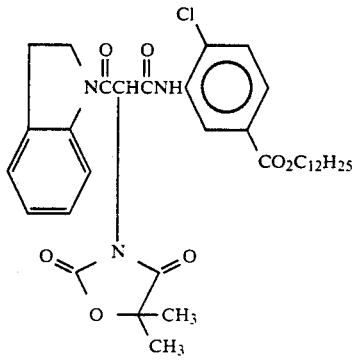
Y-13

-continued
Y-14
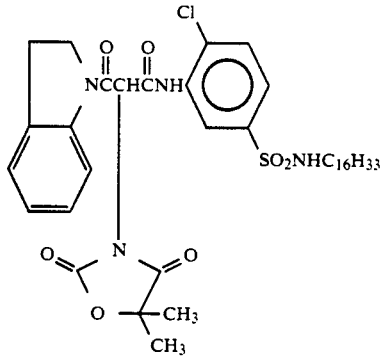
Y-15
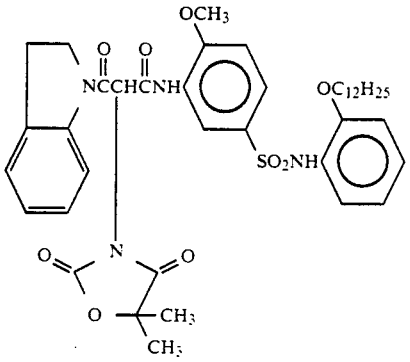
Y-16
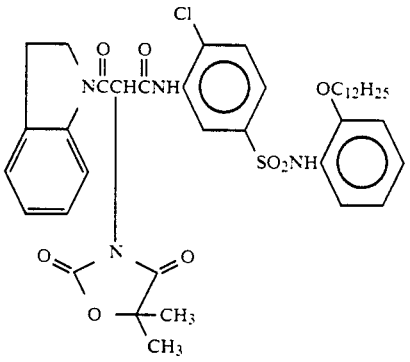
Y-17
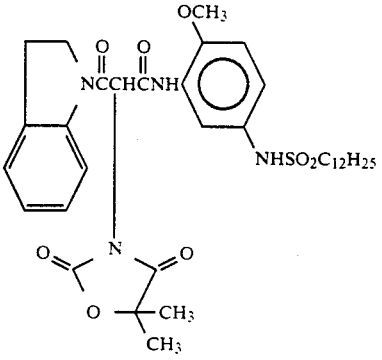
-continued
Y-18
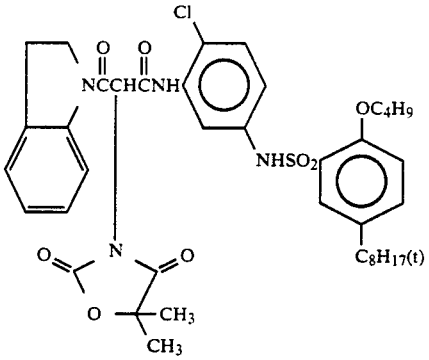
Y-19
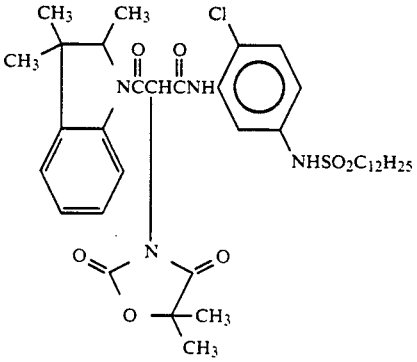
Y-20
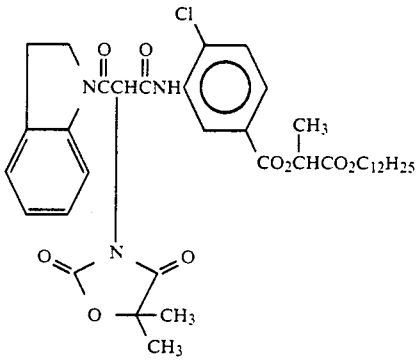
Y-21
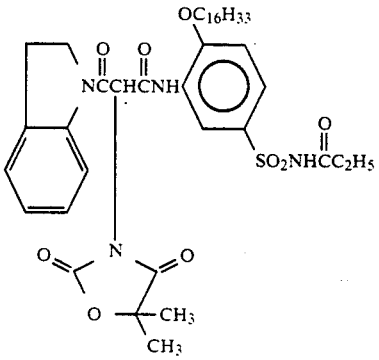

-continued
Y-22
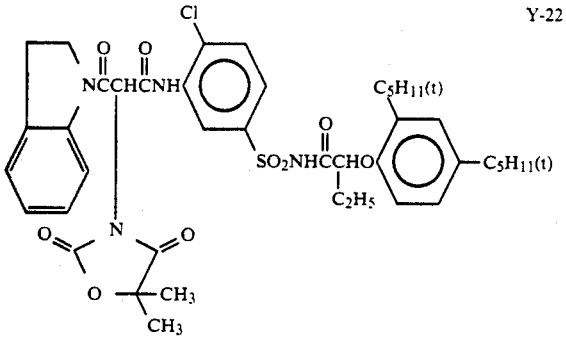
Y-23
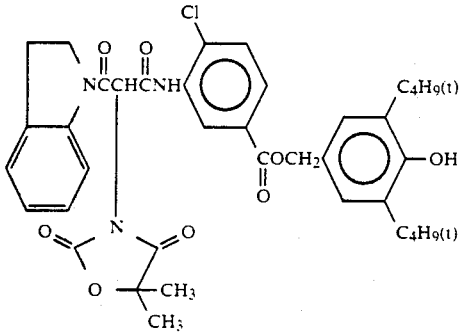
Y-24
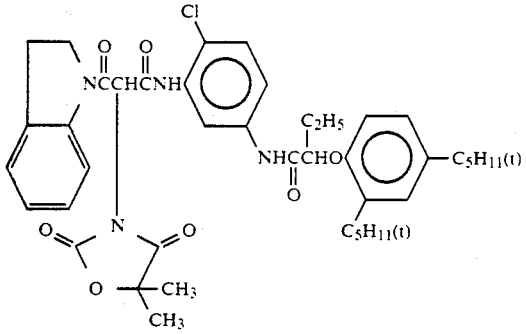
Y-25
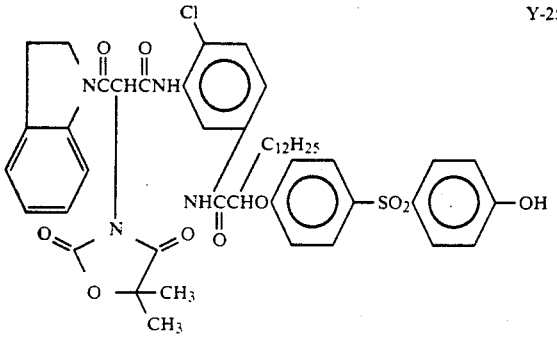
-continued
Y-26
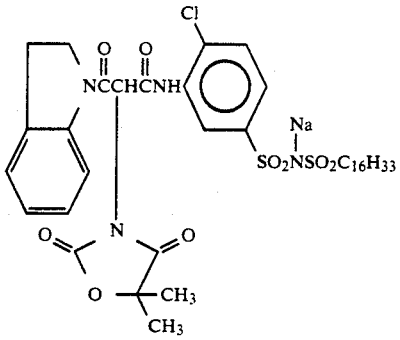
Y-27
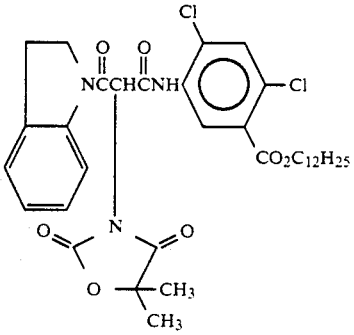
Y-28
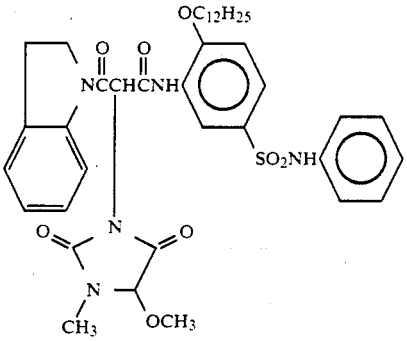
Y-29
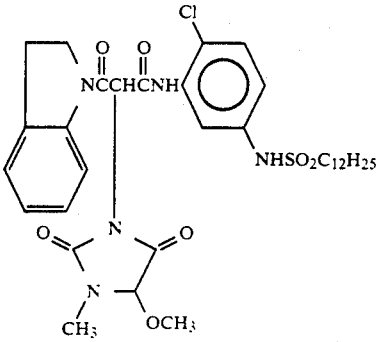

-continued
Y-30
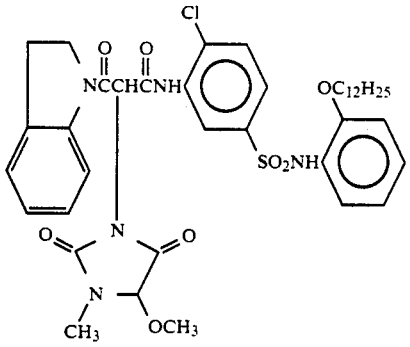
Y-31
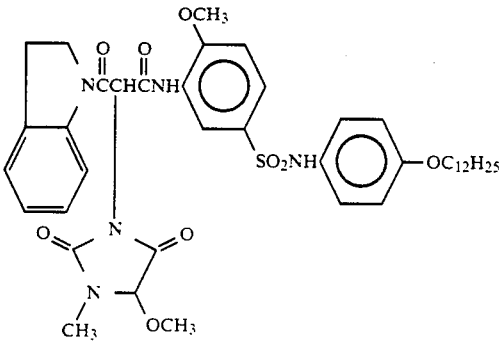
Y-32
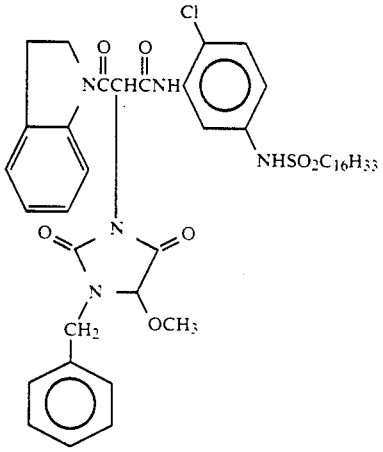
Y-33
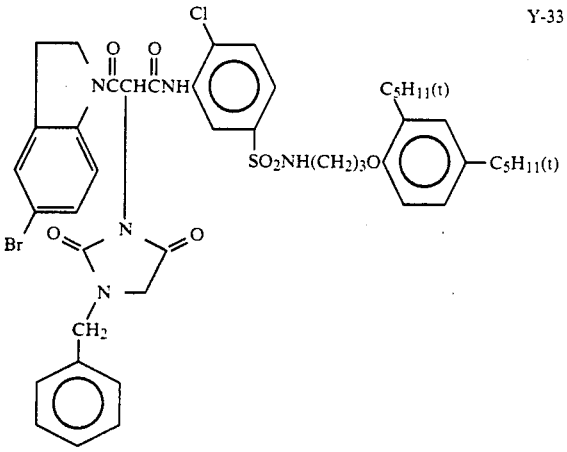
-continued
Y-34
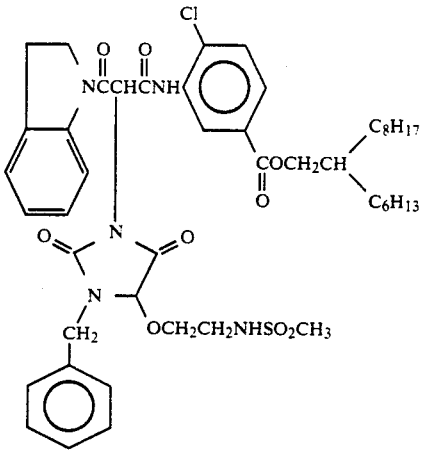
Y-35
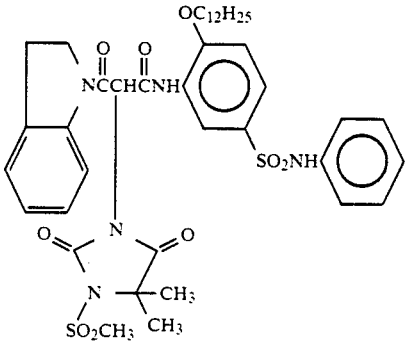
Y-36
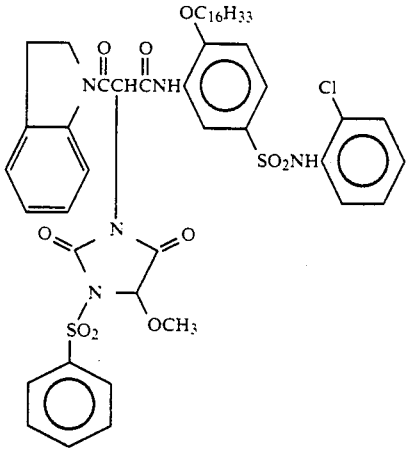
Y-37
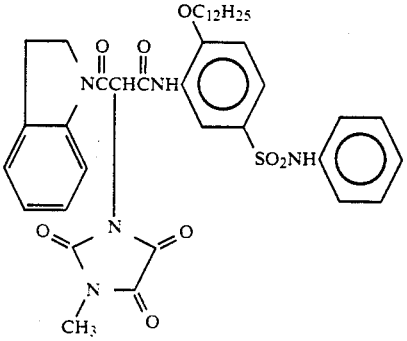

-continued
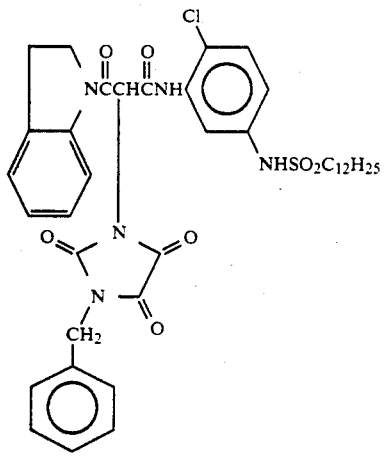
Y-38
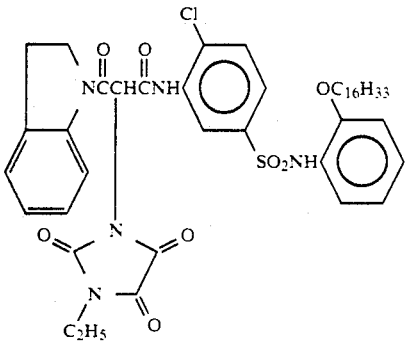
Y-39
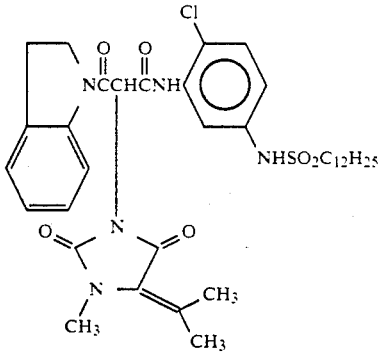
Y-40
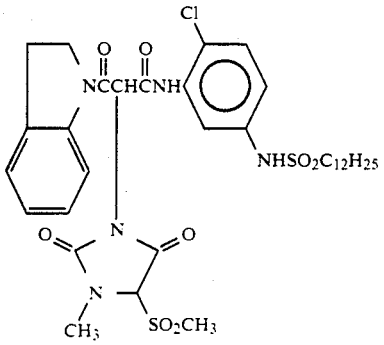
Y-41
-continued
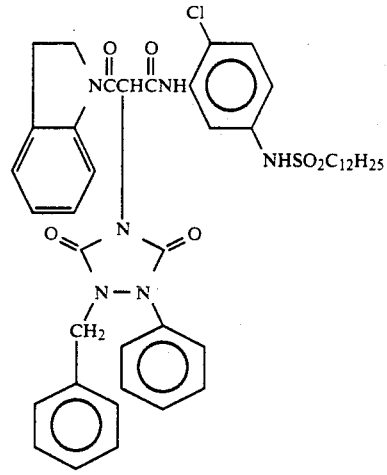
Y-42
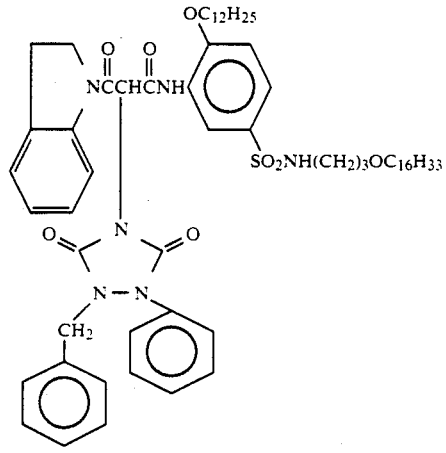
Y-43
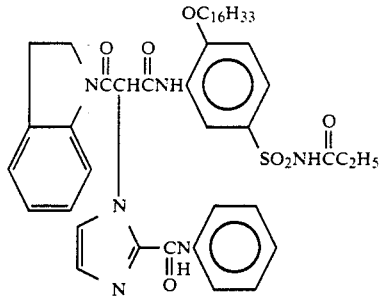
Y-44
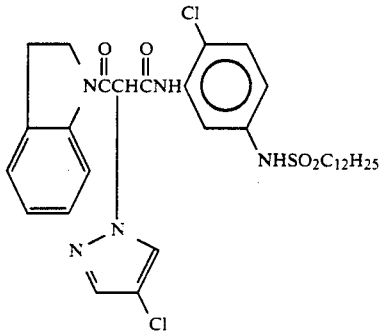
Y-45

-continued
Y-46
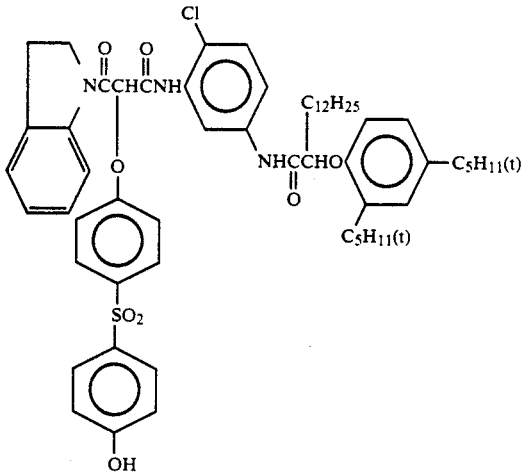
Y-47
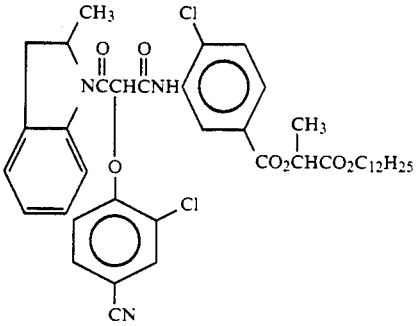
Y-48
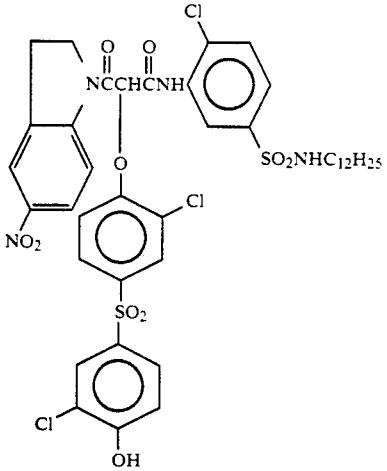
Y-49
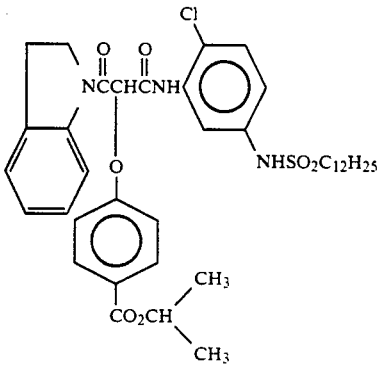
-continued
Y-50
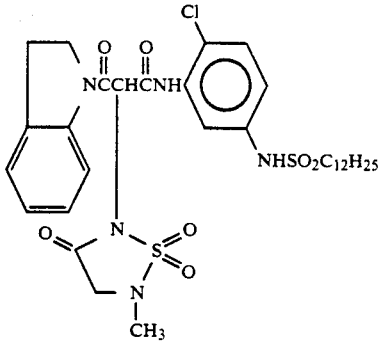
Y-51
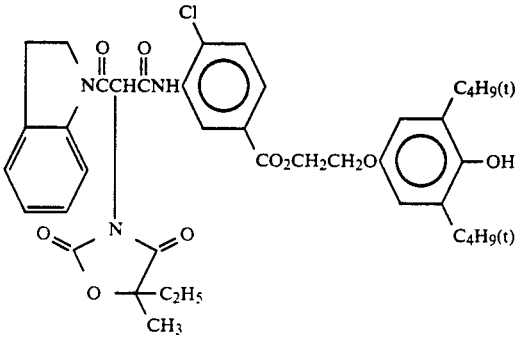
Y-52
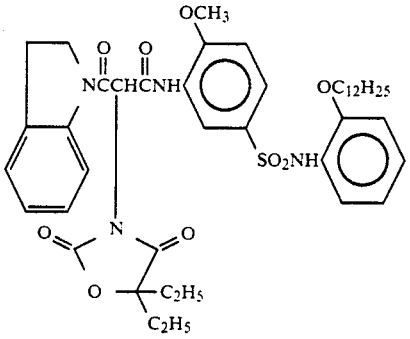
Y-53
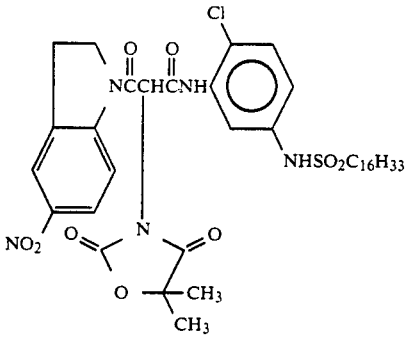
Y-54
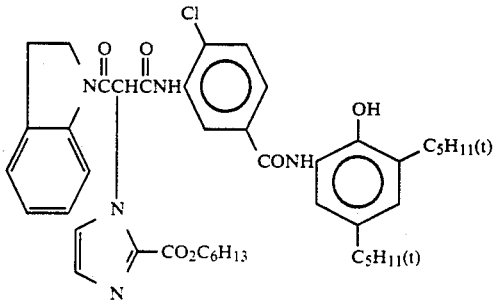

-continued

Y-55

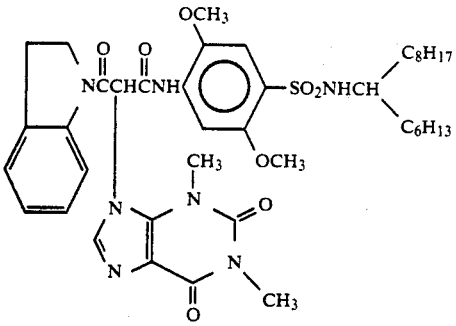

Y-56

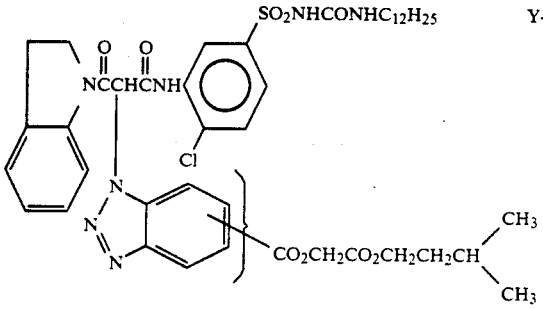

Y-57

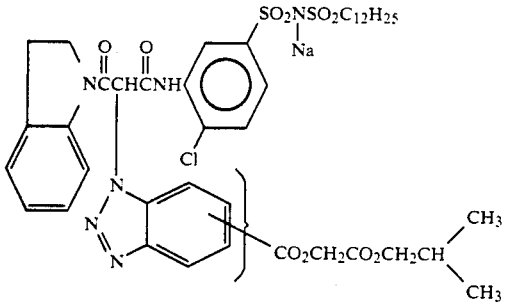

Y-58

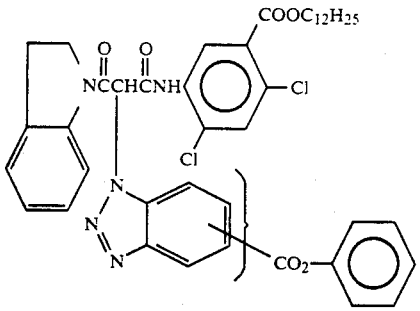

Y-59

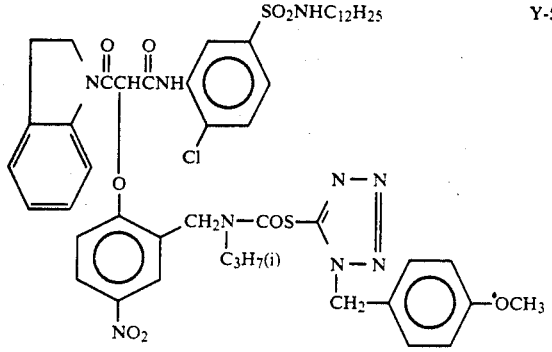

-continued

Y-60

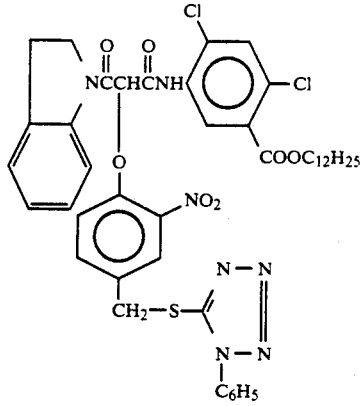

Y-61

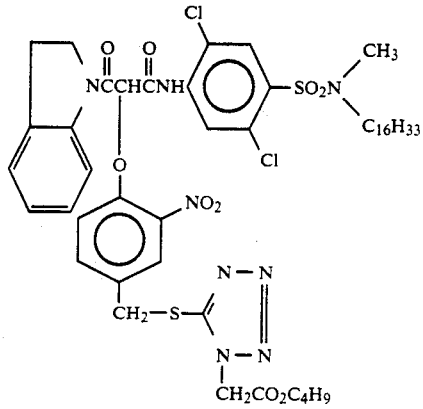

Y-62

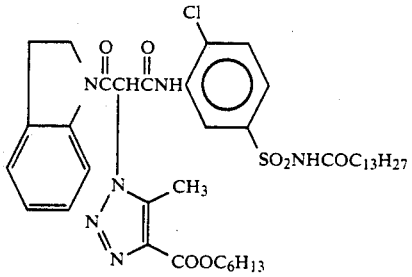

The couplers of the present invention are generally added in amounts from $2\times10^{-3}$ to $5\times10^{-1}$ mol and preferably in amounts from $1\times10^{-2}$ to $5\times10^{-1}$ mol, per mol of silver in the emulsion layer. In cases where the same color forming couplers are used conjointly, the total amount added is preferably within the range indicated above.

The mono-disperse emulsions which are used in the present invention are described below.

In the present invention, a mono-disperse emulsion is an emulsion in which the variation coefficient of the grain size distribution is not more than 20%. The preferred range for the variation coefficient is not more than 15%.

The variation coefficient is obtained using the known method as disclosed in JP-A-59-48754. (The term "JP-A" as used herein signifies an "unexamined published Japanese patent application".)

Various methods are known for the preparation of mono-disperse emulsions which can be used in the present invention and some typical examples are indicated in the following patents, including JP-B-52-153482, JP-B-55-42739, U.S. Pat. Nos. 4,431,729 and 4,259,438, British Patent 1,535,016, U.S. Pat. Nos. 4,259,438 and 4,431,729, JP-A-51-39027, JP-A-51-88017, JP-A-54-158220, JP-A-55-36829, JP-A-58-196541, JP-A-54-48521, JP-A-54-99419, JP-A-56-78831, JP-A-57-178235, JP-A-58-49938, JP-A-58-37653, JP-A-58-106532 and JP-A-58-149037. (The term "JP-B" used herein signifies an "examined Japanese patent publication".)

Furthermore, use of the method disclosed in JP-A-55-142329 is desirable.

That is to say, a mono-disperse silver halide emulsion can be obtained if, when using a silver halide seed crystal emulsion which has any grain size distribution, the rate of addition of the silver ion and the halogen ion during the crystal grain growth period is such that the crystal growth rate is from 30 to 100% of the critical growth rate of the crystals.

The mono-disperse silver halide grains in the present invention may have a regular crystalline form, such as a cubic or an octahedral form, or they may have an irregular crystalline form such as a spherical or a plate-like form, or they may have a form which has crystal defects such as twinned crystal planes, or they may have a form which is a composite of these crystalline forms. They may also be comprised of a mixture of grains which have various crystalline forms.

The use of the mono-disperse hexagonal tabular grains disclosed in JP-A-63-11928 is especially desirable.

The silver halide of the mono-disperse emulsion which is used in the present invention is silver bromide or a silver iodobromide, silver iodochloride or silver iodochlorobromide which contain not more than about 30 mol% of silver iodide. The preferred silver halides are silver iodobromides or silver iodochlorobromides which contain from about 2 mol% to about 25 mol% of silver iodide.

Moreover, most desirable for color negative materials are the silver iodobromides which contain from about 2 to 10 mol% silver iodide and most desirable for color reversal materials are the silver iodobromides which contain from about 1 to 5 mol% of silver iodide.

The mono-disperse silver halide grains which can be used in the present invention may have a uniform halogen distribution or they may be comprised of two or more phases which have different halogen compositions.

For example, the grains in which the silver iodide content of the surface layer is high when compared to that of the internal phase, such as the grains disclosed in JP-A-62-19843 for example, or the grains with a high iodine phase within the grains disclosed in JP-A-60-143331 are desirable.

The mono-disperse silver halide grains which can be used in the present invention may be the usual surface latent image type silver halide grains or they may be internal latent image type silver halide grains in which the latent image is formed principally within the grains. Furthermore, mono-disperse emulsions which have good pressure characteristics with a surface sensitivity/internal sensitivity ratio from 0.5 to 2 can also be desirably used.

Chemical sensitization of the mono-disperse emulsions which can be used in the present invention can be carried out using active gelatin as described by T.H. James in *The Theory of the Photographic Process*, 4th edition, pages 67-76 (published by Macmillan, 1977), and it can also be carried out at pAg 5 to 10, pH 5 to 8 at 30° C. to 80° C. using sulfur, selenium, tellurium, gold, platinum, palladium, iridium or a combination of a plurality of these sensitizing agents as disclosed in *Research Disclosure* volume 120, April 1974, 12008; *Research Disclosure* volume 34, June 1975, 13452, U.S. Pat. Nos. 2,642,361, 3,297,446, 3,772,031, 3,857,711, 3,901,714, 4,266,018 and 3,904,415, and British Patent 1,315,755. Chemical sensitization is carried out optimally in the presence of gold compounds and thiocyanate compounds, or in the presence of the sulfur containing compounds disclosed in U.S. Pat. Nos. 3,857,711, 4,266,018 and 4,054,457 or sulfur containing compounds such as hypo, thiourea compounds, or rhodanine based compounds, for example. Chemical sensitization can also be carried out in the presence of chemical sensitization promotors. Compounds which are known to inhibit fogging during the chemical sensitization process and increase the photographic speed, such as azaindene, azapyridazine and azapyrimidine, for example, can be used as chemical sensitization promotors. Examples of chemical sensitization promotor modifying agents have been disclosed in U.S. Pat. Nos. 2,131,038, 3,411,914 and 3,554,757, JP-A-58-126526 and on pages 138-143 of *Photographic Emulsion Chemistry* by Duffin. In addition to, or instead of, chemical sensitization, reduction sensitization using hydrogen, for example, can be used as disclosed in U.S. Pat. Nos. 3,891,446 and 3,984,249, and reduction sensitization can also be carried out using reducing agents such as stannous chloride, thiourea dioxide and polyamines as disclosed in U.S. Pat. Nos. 2,518,698, 2,743,182 and 2,743,183, or by treatment at low pAg (for example, less than 5) and/or at high pH (for example, more than 8). Furthermore, color sensitization can be increased with the methods of chemical sensitization disclosed in U.S. Pat. Nos. 3,917,485 and 3,966,476.

The sensitizing methods in which oxidizing agents are used as disclosed in JP-A-61-3134 and JP-A-61-3136 can also be applied.

These mono-disperse emulsions are used in a layer other than the highest speed emulsion among the emulsion layers of the same photosensitivity, and one or more type is included in the same layer, but the use of mixtures of two or three types is desirable, and a mixture of four or more types can be used.

A photosensitive material of the present invention should have established, on a support, at least one of blue sensitive silver halide emulsion layer, green sensitive silver halide emulsion layer and red sensitive silver halide emulsion layer, but no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have essentially the same color sensitivity but different photographic speeds. The photosensitive layer is a unit photosensitive layer which is color sensitive to blue light, green light or red light. In a multi-layer silver halide color photographic material, the arrangement of the unit photosensitive layers generally involves their establishment in the order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Non-photosensitive layers, such as various intermediate layers, for example, may be established between the above-mentioned silver halide photosensitive layers, and as uppermost and lowermost layers.

The intermediate layers may contain couplers and DIR compounds, for example, as disclosed in the specifications of JP-A-61-43748, JP-A-59-113438, JP-A-59-113440, JP-A-61-20037 and JP-A-61-20038, and they may also contain the generally used anti-color mixing compounds.

The plurality of silver halide emulsion layers constituting each unit photosensitive layer is preferably a double layer-structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order of high speed emulsion layer/low speed emulsion layer/intermediate speed emulsion layer, or low speed emulsion layer/intermediate speed emulsion layer/high speed emulsion layer, for example. Furthermore, the arrangement may be varied in the ways indicated above in cases where there are four or more layers.

Arrangements in which a donor layer (CL) for a multi-layer effect in which the spectral sensitivity distribution is different from that of the principal photosensitive layers such as the BL, GL, RL, for example, is established adjacent to, or in the proximity of, the principal photosensitive layers, as disclosed in U.S. Pat. Nos. 4,663,271, 4,705,744 and 4,707,436, JP-A-62-160448 and JP-A-63-89850 are desirable.

Various layer structures and arrangements can be selected respectively as described above according to the purpose of the photosensitive material.

The silver halide emulsions for use in the present invention are described below.

The preferred silver halides for inclusion in the photographic emulsion layers of a photographic photosensitive material used in the present invention are silver iodobromides, silver iodochlorides or silver iodochlorobromides which contain not more than about 30 mol% of silver iodide. Most desirably, the silver halide is a silver iodobromide or silver iodochlorobromide which contains from about 2 mol% to about 10 mol% of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at not more than about 0.2 microns, or large with a projected area diameter of up to about 10 microns, and the emulsions may be poly-disperse emulsions or mono-disperse emulsions.

Silver halide photographic emulsions which can be used in the present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure*, No. 307105 (November 1989), pages 863–865, by P. Glafkides in *Chimie et Physique Photographique*, published by Paul Montel, 1967, by G.F. Duffin in *Photographic Emulsion Chemistry*, published by Focal Press, 1966, and by V.L. Zelikmann et al. in *Making and Coating Photographic Emulsions*, published by Focal Press, 1964.

Furthermore, tabular grains which have an aspect ratio of at least about 3 can also be used in the present invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above-mentioned emulsions may be of the surface latent image type in which the latent image is formed principally on the surface, the internal latent image type in which the latent image is formed within the grains, or of a type in which the latent image is formed both at the surface and within the grains, but a negative type emulsion is essential. From among the internal latent image types, the emulsion may be a core/shell internal latent image type emulsion as disclosed in JP-A-63-264740. A method for the preparation of such a core/shell internal latent image type emulsion has been disclosed in JP-A-59-133542. The thickness of the shell of the emulsion differs according to the development processing, for example, but is preferably from 3 to 40 nm, and most desirably from 5 to 20 nm.

The silver halide emulsions which are used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the photosensitive silver halide emulsion, the form of the grains or photographic speed can be used in the form of a mixture in the same layer in a photosensitive material of the present invention.

The use of silver halide grains in which the grain surface has been fogged as disclosed in U.S. Pat. No. 4,082,553, silver halide grains in which the grain interior has been fogged as disclosed in U.S. Pat. No. 4,626,498 and JP-A-59-214852 or colloidal silver is desirable in the photosensitive silver halide emulsion layers and/or essentially non-photosensitive hydrophilic colloid layers. Silver halide grains in which the grain interior or surface has been fogged are silver halide grains which can be developed uniformly (not in the form of the image) irrespective of whether they are in an unexposed part or an exposed part of the photosensitive material. Methods for the preparation of silver halide grains in which the interior or surface has been fogged have been disclosed in U.S. Pat. No. 4,626,498 and JP-A-59-214852.

The silver halide which forms the internal nuclei of core/shell type silver halide grains in which the grain interior has been fogged may have the same halogen composition or a different halogen composition. The silver halide in which the grain interior or surface has been fogged may be silver chloride, a silver chlorobromide, a silver iodobromide or a silver chloroiodobromide. No particular limitation is imposed upon the grain size of these fogged silver halide grains, but an average grain size from 0.01 to 0.75 μm, and especially from 0.05 to 0.6 μm, is preferred. Furthermore, no particular limitation is imposed upon the form of the grains and they may be regular grains, and they may be poly-disperse emulsions, but mono-disperse emulsions (in which at least 95% in terms of the weight or number of silver halide grains have a grain size within ±40% of the average grain size) are preferred.

It is preferred that a latent image distribution of silver halide grains in at least one emulsion present in at least on emulsion layer in the photographic photosensitive material according to the present invention has at least one maximum value within the silver halide grains and that the maximum value is located at a depth of less than 0.01 μm from the surface. The term "latent image distribution" as used herein means the depth from the grain surface of the latent image (x μm) as the abscissa and the number of the images (y) as the ordinate, wherein x is represented by the following equation:

$$x = \frac{S}{2} \times \left(1 - 3\sqrt{\frac{Agi}{Ago}}\right)$$

wherein S is an average grain diameter of the silver halide emulsion; Agi is the residual amount of silver after subjecting an unexposed, emulsion coated sample to the following treatment; and Ago is the amount of silver before the following treatment; and y is a reciprocal value of the exposure giving a density of (fog+0.2) when the following treatment is effected after the sample is exposed to white light for 1/100 second.

The treatment for obtaining the above-described latent image distribution is set forth below.

To the treating solution comprising:

| | |
|---|---|
| N-Methylol-p-aminophenol sulfate | 2.5 g |
| Sodium L-ascorbate | 10 g |
| Sodium metaborate | 35 g |
| Potassium bromide | 1 g |
| Water to make | 1 l |
| pH | 9.6 |

0 to 10 g/l of anhydrous sodium sulfite are added and the sample is treated at 25° C. for 5 minutes in the resulting solution. Varying the amount of anhydrous sodium sulfite from 0 to 10 g/l causes the change in depth of the latent image from the surface within the silver halide grains being developed during the treatment and thus the change in the number of latent images in the direction of depth can be determined.

The use of non-photosensitive fine grain silver halides is desirable in the present invention. Non-photosensitive fine grain silver halides are fine grain silver halides which are not photosensitive at the time of the image-wise exposure for obtaining the dye image and which undergo essentially no development during development processing. Those non-photosensitive fine grain silver halides which have not been pre-fogged are preferred.

The fine grain silver halide has a silver bromide content from 0 to 100 mol% and may contain silver chloride and/or silver iodide as required. Those which have a silver iodide content from 0.5 to 10 mol% are preferred.

The fine grain silver halide has an average grain size (the average value of the diameters of the circles corresponding to the projected areas) preferably from 0.01 to 0.5 μm, and most desirably from 0.02 to 0.2 μm.

The fine grain silver halide can be prepared using the same methods as used in general for the preparation of photosensitive silver halides. In this case, the surface of the silver halide grains does not need to be optically sensitized and neither is there any need for spectral sensitization. However, the preaddition of known stabilizers such as triazole, azaindene, benzothiazolium or mercapto based compounds or zinc compounds, for example, before addition of the fine grain silver halide to the coating liquid is desirable. Colloidal silver can also be included desirably in the layers which contain these fine grain silver halide grains.

The coated weight of silver in a photosensitive material of the present invention is preferably not more than 6.0 g/m$^2$, and most desirably not more than 4.5 g/m$^2$.

Known photographically useful additives which can be used in the present invention have also been disclosed in the three *Research Disclosures* referred to above, and the locations of these disclosures are also indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Supersensitizers | Pages 23–24 | Page 648 right hand column - page 649 right hand column | Pages 866–868 |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors, Surfactants | Pages 26–27 | Page 650, right hand column | Pages 875–876 |
| 13. Antistatic agents | Page 27 | Page 650, right hand column | Pages 876–877 |
| 14. Matting Agents | | | Pages 878–879 |

Furthermore, addition of the compounds which can react with and fix formaldehyde as disclosed in U.S. Pat. Nos. 4,411,987 and 4,435,503 to the photosensitive material is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 is desirable in a photosensitive material of the present invention.

The inclusion of compounds which release fogging agents, development accelerators, silver halide solvents or precursors of these materials irrespective of the amount of developed silver produced by development processing disclosed in JP-A-1-106052 is desirable in a photosensitive material of the present invention.

The inclusion of the dyes dispersed using the methods disclosed in International Patent laid open WO88/04794 and JP-A-1-502912, or the dyes disclosed in EP 317,308A, U.S. Pat. No. 4,420,555 and JP-A-1-259358 is desirable in a photosensitive material of the present invention.

Various color couplers can be used in the present invention, and actual examples have been disclosed in the patents cited in the aforementioned *Research Disclosure* No. 17643, sections VII-C - G, and *Research Disclosure* No. 307105, sections VII-C - G.

Those disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred as well as are those represented by formulae (1) and (2) of the present invention as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795 are especially desirable.

Phenol and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A-64-553, JP-A-64-554, JP-A-64-555 and JP-A-64-556, and the imidazole based couplers disclosed in U.S. Pat. No. 4,818,672 can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers in which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 are also desirable.

The use of compounds which release photographically useful residual groups on coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are preferred.

The bleaching accelerator releasing couplers disclosed in *Research Disclosure* No. 11449, *Research Disclosure* No. 24241 and JP-A-61-201247 are effective for shortening the time of the processing operation which has a bleaching function, and they are particularly effective in cases where they are added to photosensitive materials in which the aforementioned tabular silver halide grains are used. Those disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents etc. via a redox reaction with the oxidized form of a developing agent disclosed in JP-A-60-107029, JP-A-60-252340, JP-A-1-44940 and JP-A-1-45687 are also desirable.

Other compounds which can be used in the photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes in which the color is restored after elimination disclosed in European Patents 173,302A and 313,308A, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known methods.

Examples of high boiling point solvents which can be used in the oil in water dispersion method have been disclosed, for example, in U.S. Pat. No. 2,322,027. Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate and bis(1,1-diethylpropyl)phthalate), phosphoric acid ester or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecyl-pyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. Nos. 4,199,363, and in West German Patent Applications (OLS) 2,541,274 and 2,541,230.

The addition to the color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941 is desirable.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The photosensitive materials of the present invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{\frac{1}{2}}$ is preferably not more than 30 seconds and most desirably not more than 20 seconds. Here, the film thickness signifies the film thickness measured under conditions of 25° C., 55% relative humidity (2 days) and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129, and $T_{\frac{1}{2}}$ is defined as the time taken to reach half the saturated film thickness, taking 90% of the maximum swollen film thickness reached on processing the material for 3 minutes 15 seconds in a color developer at 30° C. as the saturated film thickness.

The film swelling rate $T_{\frac{1}{2}}$ can be adjusted by adding film hardening agents to the gelatin which is used as a binder, or by changing the aging conditions after coating. Furthermore, a swelling factor from 150% to 400% is preferred. The swelling factor can be calculated from the maximum swollen film thickness obtained under the conditions described above using the expression (maximum swollen film thickness minus film thickness)/film thickness.

The establishment of a hydrophilic colloid layer (known as a backing layer) of total dry film thickness from 2 μm to 20 μm on the opposite side from the emulsion layers is desirable in a photosensitive material of the present invention. The inclusion of light absorbing agents, filter dyes, ultraviolet absorbers, antistatic agents, film hardening agents, binders, plasticizers, lubricants, coating promotors and surfactants, for example, as described before, in this backing layer is desirable. The swelling factor of the backing layer is preferably from 150% to 500%.

Color photographic photosensitive materials which are in accordance with the present invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of the aforementioned *Research Disclosure* No. 307105.

The color developers used for the development processing of photosensitive materials of the present invention are preferably aqueous alkaline solutions which contain a primary aromatic amine based color developing agent as the principal component. Aminophenol based compounds are also useful, but the use of p-phenylenediamine based compounds as color developing agents is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxy-ethylidene-1,1-diphosphonic acid, nitrilo-N,N,N-trimethylene-phosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone and aminophenols such as N-methyl-p-aminophenol, for example, can be used individually, or in combinations, in the black and white developer. The pH of these color developers and black and white developers is generally from 9 to 12. Furthermore, the replenishment rate for these developers depends on the color photographic photosensitive material which is being processed but, in general, it is not more than 3 liters per square meter of photosensitive material, and it can be set to not more than 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the open factor which is defined below. Thus:

$$\text{Open Factor} = [\text{Processing bath and Air Contact Area (cm}^2)] \div [\text{Processing Bath Volume (cm}^3)]$$

The above mentioned open factor is preferably not more than 0.1, and most desirably from 0.001 to 0.05. As well as the establishment of a shielding material such as a floating lid, for example, on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes, for example. Furthermore, the replenishment rate can be reduced by using some means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (a bleach-fixing process) or it may be carried out separately. Moreover, a bleach-fixing process can be carried out after a bleaching process in order to speed up processing. Moreover, processing can be carried out in two connected bleach-fix baths, a fixing process can be carried out before a bleach-fixing process or a bleaching process can be carried out after a bleach-fixing process, as required. Compounds of multi-valent metals, such as iron(III), for example, peracids, quinones and nitro compounds can be used as bleaching agents. Typical bleaching agents include organic complex salts of iron(III), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid or malic acid. From among these materials, the use of aminopolycarboxylic acid iron(III) complex salts, and principally of ethylenediaminetetraacetic acid iron(III) complex salts and 1,3-diaminopropanetetraacetic acid iron(III) salts, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix prebaths. Actual examples of useful bleach accelerators have been disclosed in the specifications discussed hereinbelow. Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the photo sensitive material. These bleaching accelerators are especially effective when bleach-fixing color photosensitive materials for use in cameras.

The inclusion of organic acids as well as the compounds indicated above in the bleach baths and bleach-fix baths is desirable for preventing the occurrence of bleach staining. Compounds which have an acid dissociation constant (pKa) from 2 to 5 are especially desirable for the organic acids, and in practice acetic acid, propionic acid and hydroxyacetic acid, for example, are preferred.

Thiosulfate, thiocyanate, thioether based compounds, thioureas and large amounts of iodide can be used, for example, as the fixing agent which is used in a fix bath or a bleach-fix bath, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts from 0.1 to 10 mol/liter to the fixing bath or bleach-fixing bath is desirable in the present invention.

A short total desilvering processing time within the range where desilvering failure does not occur is preferred. The desilvering time is preferably from 1 to 3 minutes, and most desirably from 1 to 2 minutes. Furthermore, the processing temperature is from 25° C. to 50° C., and preferably from 35° C. to 45° C. The desilvering rate is improved and the occurrence of staining after processing is effectively prevented within the preferred temperature range.

Agitation as strongly as possible during the desilvering process is desirable. Actual examples of methods of strong agitation include the method in which a jet of processing liquid is made to impinge on the emulsion surface of the photosensitive material as disclosed in JP-A-62-183460, the method in which the . agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the desilvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced and this is very effective for preventing deterioration in processing bath performance. This is especially effective for shortening the processing time in each process and for reducing the replenishment rate of each processing bath.

The silver halide color photographic photosensitive materials of the invention are generally subjected to a water washing process and/or stabilizing process after the desilvering process. The amount of wash water used in the washing process can be fixed within a wide range, depending on the application and the nature (depending on the materials such as couplers which have been used, for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers*, Volume 64 (May 1955). The amount of wash water used can be greatly reduced by using the multi-stage counter-flow system noted in the aforementioned literature, but bacteria proliferate due to the increased residence time of the water in the tanks and problems arise with the suspended matter which is produced and then becoming attached to the photosensitive material. The method in which the calcium ion and magnesium ion concentrations are reduced, disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Micro-organisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of the present invention is from 4 to 9, and preferably from 5 to 8. The washing water temperature and the washing time can be set variously in accordance with the nature and application of the photosensitive material but, in general, washing conditions from 20 seconds to 10 minutes at a temperature from 15° C. to 45° C., and preferably from 30 seconds to 5 minutes at a temperature from 25° C. to 40° C., are selected. Moreover, the photosensitive materials of the invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with camera color photosensitive materials are an example of such a process. Aldehydes such as formalin and glutaraldehyde, N-methylol compounds, hexamethylenetetramine and aldehyde/bisulfite addition compounds can be used, for example, as dye stabilizing agents. Various chelating agents and fungicides can also be added to these stabilizing baths.

The overflow which accompanies replenishment of the above-mentioned water washing or stabilizing baths can be reused in other processes, such as the desilvering process, for example.

Concentration correction with the addition of water is desirable in cases where the above-mentioned processing baths become concentrated due to evaporation when processing in an automatic processor, for example.

Color developing agents can be incorporated into a silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of the present invention with a view to accelerating color development. Typical compounds have been disclosed, for example, in JP-A-56-64339, JP-A-57-144547 and JP-A-58-115438.

The various processing baths in the present invention are used at a temperature from 10° C. to 50° C. The standard temperature is generally from 33° C. to 38° C., but accelerated processing and shorter processing times can be realized at higher temperatures while, on the other hand, increased picture quality and improved processing bath stability can be achieved at lower temperatures.

Furthermore, the silver halide photosensitive materials of the present invention can also be used in the heat developable photosensitive materials disclosed, for example, in U.S. Pat. No. 4,500,626, JP-A-60-133449, JP-A-59-218443, JP-A-61-238056 and European Patent 210,660A2.

ILLUSTRATIVE EXAMPLES

The invention is described in more detail below by means of illustrative examples, but the invention is not limited by these examples.

EXAMPLE 1

Preparation of Sample 101

A multi-layer color photosensitive material comprised of the layers in which the compositions are indicated below was prepared on a cellulose triacetate film support of thickness 127μ on which an under-layer . had been established, and this was taken as sample 101. The numbers indicate the amounts added per square meter. Moreover, the effect of the compounds added is not limited to application described.

| | |
|---|---|
| First Layer-Anti-halation Layer | |
| Black colloidal silver | 0.20 gram |
| Gelatin | 1.9 grams |
| Ultraviolet absorber U-1 | 0.04 gram |
| Ultraviolet absorber U-2 | 0.1 gram |
| Ultraviolet absorber U-3 | 0.1 gram |
| Ultraviolet absorber U-4 | 0.1 gram |
| Ultraviolet absorber U-6 | 0.1 gram |
| High boiling point organic solvent Oil-1 | 0.1 gram |
| Microerystalline solid dispersion of dye E-1 | 0.1 gram |
| Second Layer-Intermediate Layer | |
| Gelatin | 0.40 gram |
| Compound Cpd-D | 5 mg |
| Compound Cpd-L | 5 mg |
| Compound Cpd-M | 3 mg |
| High boiling point organic solvent Oil-3 | 0.1 gram |
| Dye D-4 | 0.4 mg |
| Third Layer-Intermediate Layer | |
| A fine grain silver iodobromide emulsion in which the surface and interior had been fogged (average grain size 0.06 μm, variation coefficient 18%, AgI content 1 mol %) | as silver 0.05 gram |
| Gelatin | 0.4 gram |
| Fourth Layer-Low Speed Red-Sensitive | |

-continued

| Emulsion Layer | |
|---|---|
| Emulsion A | as silver 0.1 gram |
| Emulsion B | as silver 0.4 gram |
| Gelatin | 0.8 gram |
| Coupler C-1 | 0.15 gram |
| Coupler C-2 | 0.05 gram |
| Coupler C-3 | 0.05 gram |
| Compound Cpd-D | 10 mg |
| High boiling point organic solvent Oil-2 | 0.1 gram |
| **Fifth Layer-Medium Speed Red-Sensitive Emulsion Layer** | |
| Emulsion B | as silver 0.2 gram |
| Emulsion C | as silver 0.3 gram |
| Gelatin | 0.8 gram |
| Coupler C-1 | 0.2 gram |
| Coupler C-2 | 0.05 gram |
| Coupler C-3 | 0.2 gram |
| High boiling point organic solvent Oil-2 | 0.1 gram |
| **Sixth Layer-High Speed Red-Sensitive Emulsion Layer** | |
| Emulsion D | as silver 0.4 gram |
| Gelatin | 1.1 grams |
| Coupler C-1 | 0.15 gram |
| Coupler C-2 | 0.15 gram |
| Coupler C-3 | 0.7 gram |
| Additive P-1 | 0.1 gram |
| **Seventh Layer-Intermediate Layer** | |
| Gelatin | 0.6 gram |
| Additive M-1 | 0.3 gram |
| Anti-color mixing agent Cpd-K | 2.6 mg |
| Ultraviolet absorber U-1 | 0.1 gram |
| Untraviolet absorber U-6 | 0.1 gram |
| Dye D-1 | 0.02 gram |
| Compound Cpd-D | 5 mg |
| Compound Cpd-L | 5 mg |
| Compound Cpd-M | 5 mg |
| **Eighth Layer-Intermediate Layer** | |
| A fine grain silver iodobromide emulsion in which the surface and interior had been fogged (average grain size 0.06 μm, variation coefficient 16%, AgI content 0.3 mol %) | as silver 0.02 gram |
| Gelatin | 1.0 gram |
| Additive P-1 | 0.2 gram |
| Anti-color mixing agent Cpd-J | 0.1 mg |
| Anti-color mixing agent Cpd-A | 0.1 mg |
| **Ninth Layer-Low Speed Green-Sensitive Emulsion Layer** | |
| Emulsion E | as silver 0.1 gram |
| Emulsion F | as silver 0.2 gram |
| Emulsion G | as silver 0.2 gram |
| Gelatin | 0.5 gram |
| Coupler C-7 | 0.05 gram |
| Coupler C-8 | 0.2 gram |
| Compound Cpd-B | 0.03 gram |
| Compound Cpd-D | 10 mg |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.1 gram |
| High boiling point organic solvent Oil-2 | 0.1 gram |
| **Tenth Layer-Medium Speed Green-Sensitive Emulsion Layer** | |
| Emulsion G | as silver 0.3 gram |

-continued

| | |
|---|---|
| Emulsion H | as silver 0.1 gram |
| Gelatin | 0.6 gram |
| Coupler C-7 | 0.2 gram |
| Coupler C-8 | 0.1 gram |
| Compound Cpd-B | 0.03 gram |
| Compound Cpd-E | 0.02 gram |
| Compound Cpd-F | 0.02 gram |
| Compound Cpd-G | 0.05 gram |
| Compound Cpd-H | 0.05 gram |
| High boiling point organic solvent Oil-2 | 0.01 gram |
| **Eleventh Layer-High Speed Green-Sensitive Emulsion Layer** | |
| Emulsion I | as silver 0.5 gram |
| Gelatin | 1.0 gram |
| Coupler C-4 | 0.3 gram |
| Coupler C-8 | 0.1 gram |
| Compound Cpd-B | 0.08 gram |
| Compound Cpd-E | 0.02 gram |
| Compound Cpd-F | 0.02 gram |
| Compound Cpd-G | 0.02 gram |
| Compound Cpd-H | 0.02 gram |
| High boiling point organic solvent Oil-1 | 0.02 gram |
| High boiling point organic solvent Oil-2 | 0.02 gram |
| **Twelfth Layer-Intermediate Layer** | |
| Gelatin | 0.6 gram |
| Dye D-1 | 0.1 gram |
| Dye D-2 | 0.05 gram |
| Dye D-3 | 0.07 gram |
| **Thirteenth Layer-Yellow Filter Layer** | |
| Yellow colloidal silver | as silver 0.07 gram |
| Gelatin | 1.1 gram |
| Anti-color mixing agent Cpd-A | 0.01 gram |
| High boiling point organic solvent Oil-1 | 0.01 gram |
| Microcrystalline solid dispersion of dye E-2 | 0.05 gram |
| **Fourteenth Layer-Intermediate Layer** | |
| Gelatin | 0.6 gram |
| **Fifteenth Layer-Low Speed Blue-Sensitive Emulsion Layer** | |
| Emulsion J | as silver 0.2 gram |
| Emulsion K | as silver 0.3 gram |
| Emulsion L | as silver 0.1 gram |
| Gelatin | 0.8 gram |
| Coupler C-5 | 0.2 gram |
| Coupler C-9 | 0.4 gram |
| **Sixteenth layer-Medium Speed Blue-Sensitive Emulsion Layer** | |
| Emulsion L | as silver 0.1 gram |
| Emulsion M | as silver 0.4 gram |
| Gelatin | 0.9 gram |
| Coupler C-5 | 0.3 gram |
| Coupler C-6 | 0.1 gram |
| Coupler C-9 | 0.1 gram |
| **Seventeenth Layer-High Speed Blue-Sensitive Emulsion Layer** | |
| Emulsion N | as silver 0.4 gram |
| Gelatin | 1.2 grams |
| Coupler C-6 | 0.6 gram |
| Coupler C-9 | 0.1 gram |
| **Eighteenth Layer-First Protective Layer** | |
| Gelatin | 0.7 gram |
| Ultraviolet absorber U-1 | 0.04 gram |
| Ultraviolet absorber U-2 | 0.01 gram |
| Ultraviolet absorber U-3 | 0.03 gram |
| Ultraviolet absorber U-4 | 0.03 gram |
| Ultraviolet absorber U-5 | 0.05 gram |

-continued

| | |
|---|---|
| Ultraviolet absorber U-6 | 0.05 gram |
| High boiling point organic solvent Oil-1 | 0.02 gram |
| Formalin scavengers | |
| Cpd-C | 0.2 gram |
| Cpd-1 | 0.4 gram |
| Dye D-3 | 0.05 gram |
| Anti-color mixing agent Cpd-A | 0.02 gram |
| Nineteenth Layer-Second Protective Layer | |
| Colloidal silver | as silver 0.1 mg |
| Fine grain silver iodobromide emulsion (average grain size 0.06 μm, AgI content 1 mol %) | as silver 0.1 gram |
| Gelatin | 0.4 gram |
| Twentieth Layer-Third Protective Layer | |
| Gelatin | 0.4 gram |
| Poly(methyl methacrylate) (average particle size 1.5 μm) | 0.1 gram |
| Methyl methacrylate/acrylate acid (4:6) copolymer (average particle size 1.5 μm) | 0.1 gram |
| Silicone oil | 0.03 gram |
| Surfactant W-1 | 3.0 mg |
| Surfactant W-2 | 0.03 gram |

Furthermore, additives F-1 to F-8 were added to all of the emulsion layers in addition to the components indicated above. Moreover, the gelatin hardening agent H-1 and the surfactants W-3, W-4, W-5, W-6 and W-7 for coating purposes and emulsification purposes were added to each layer in addition to the components indicated above.

Moreover, phenol, 1,2-benzisothiazolin-3-one, 2-phenoxyethanol and phenethyl alcohol were added as biocides and fungicides.

The compounds used in sample 101 are indicated below.

C-1

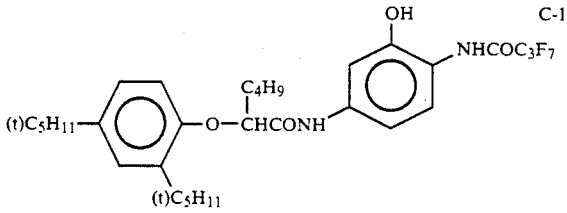

C-2

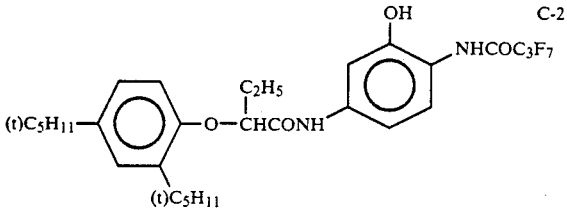

C-3

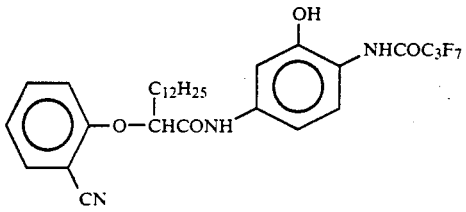

-continued

C-4

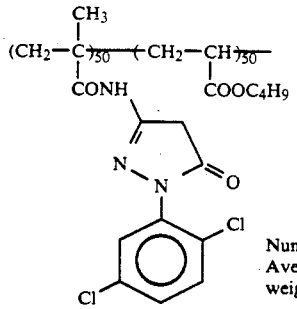

Numbers are wt %. Average molecular weight: about 25,000

C-5

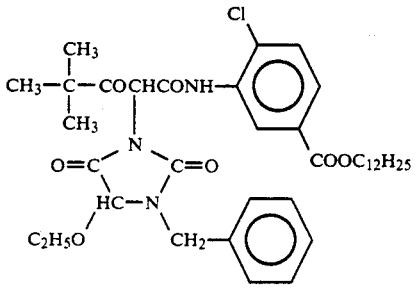

C-6

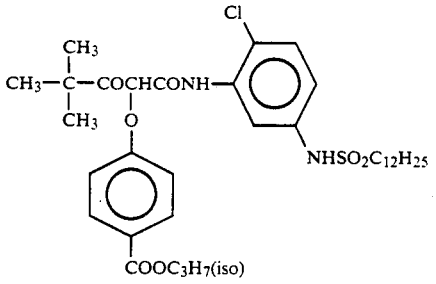

C-7

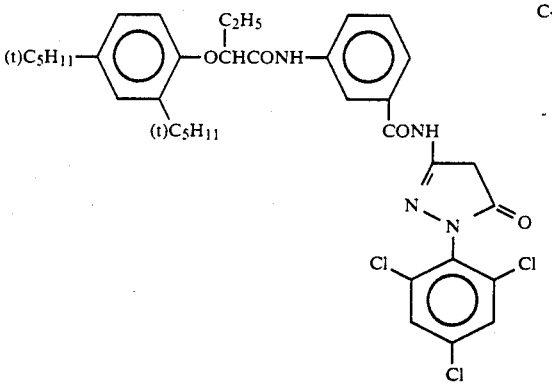

C-8

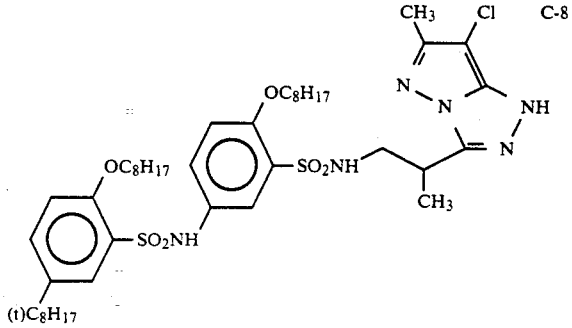

-continued
C-9
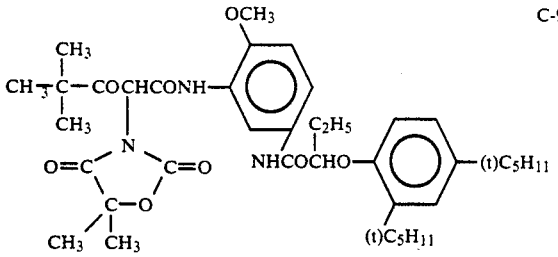
Dibutyl phthalate — Oil-1
Tricresyl phosphate — Oil-2
Oil-3
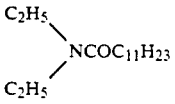
Cpd-A
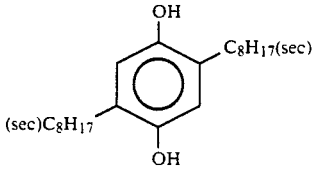
Cpd-B
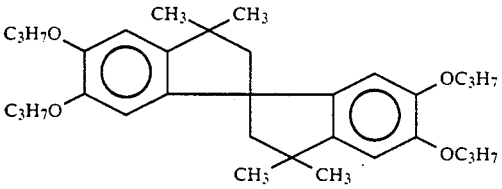
Cpd-C
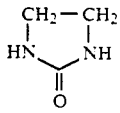
Cpd-D
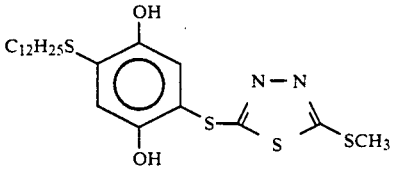
Cpd-E
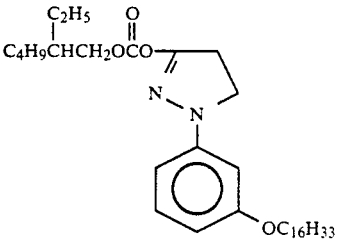
-continued
Cpd-F
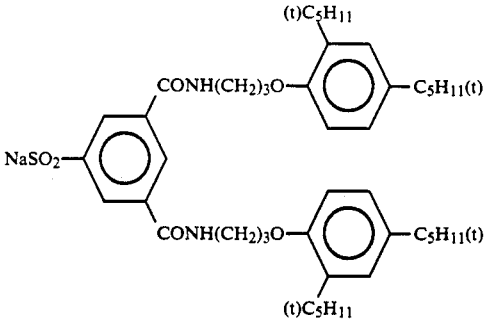
Cpd-G
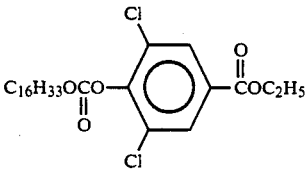
Cpd-H
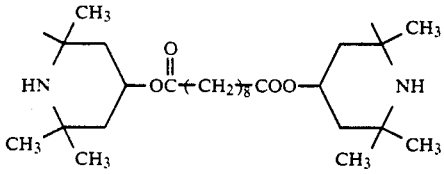
Cpd-I
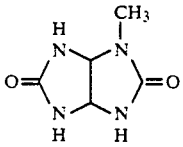
Cpd-J
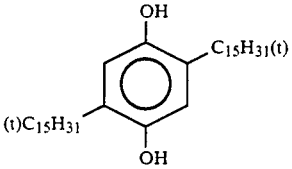
Cpd-K
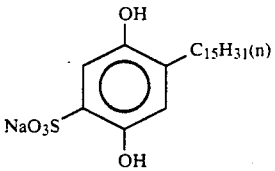
Cpd-L
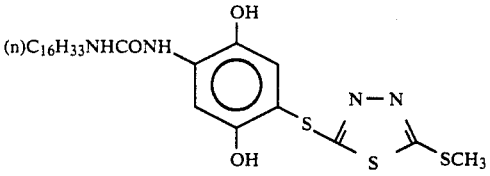
Cpd-M
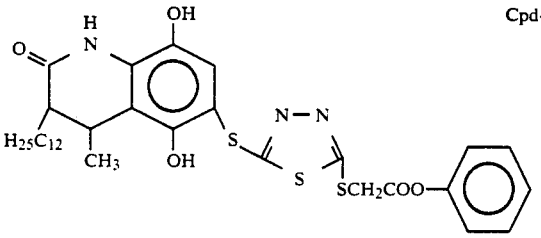

-continued
U-1
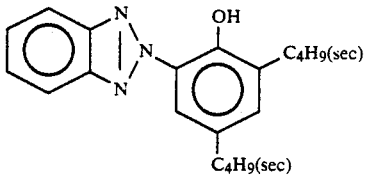
U-2
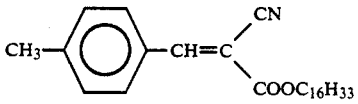
U-3
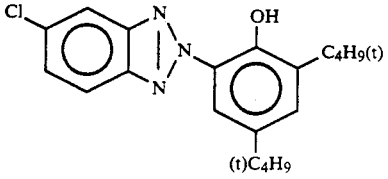
U-4
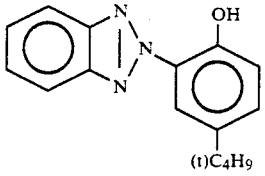
U-5
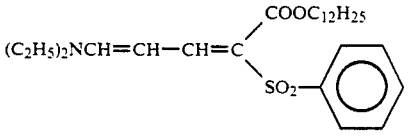
U-6
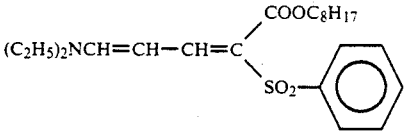
S-1
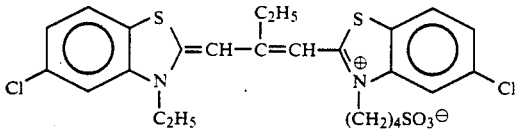
S-2
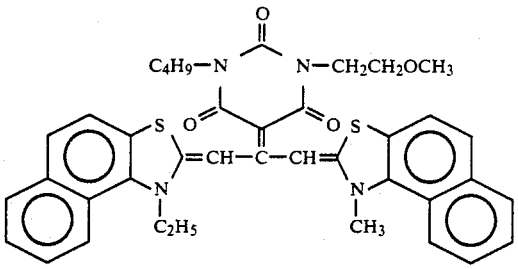
S-3
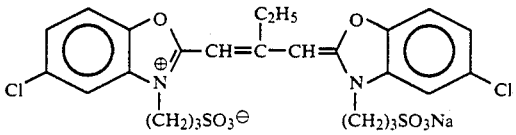
-continued
S-4
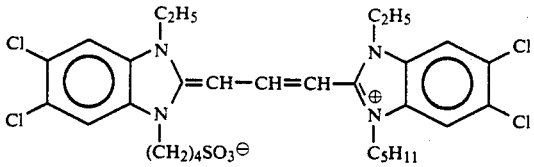
S-5
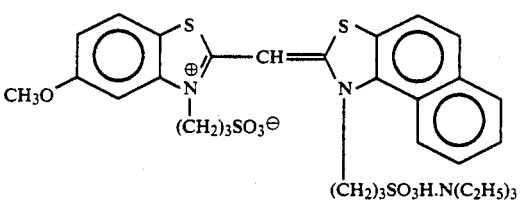
S-6
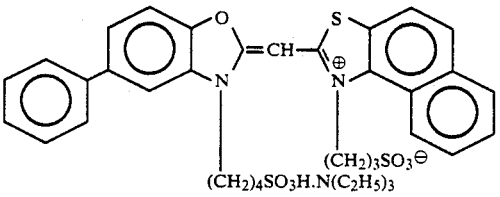
S-7
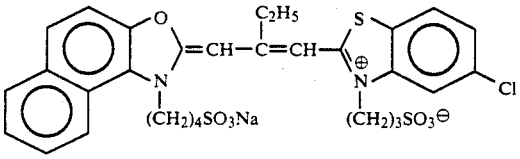
S-8
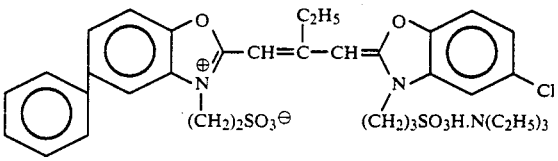
D-1
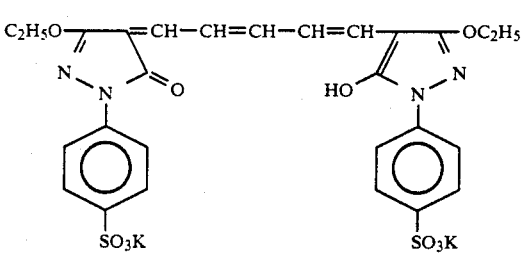
D-2
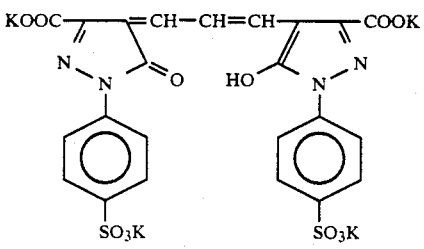

-continued
D-3
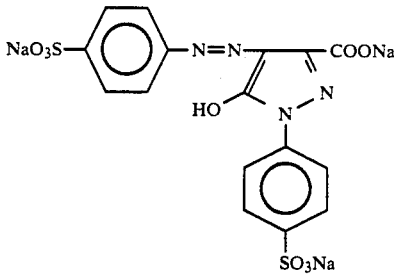
D-4
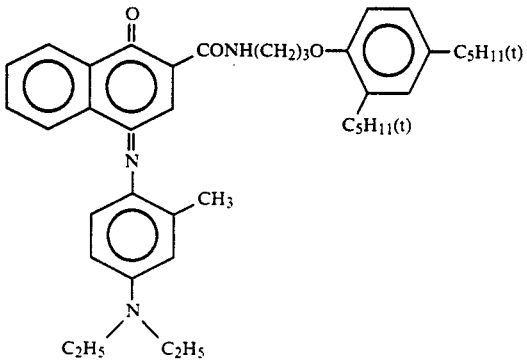
E-1
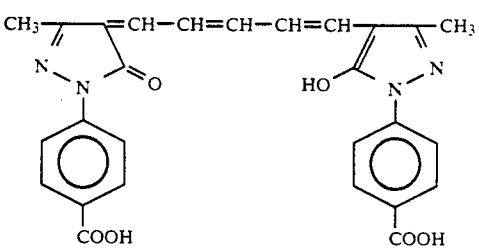
E-2
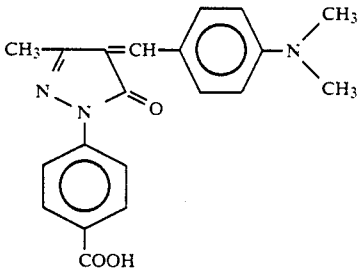
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2{}^{\oplus}N(CH_3)_3$
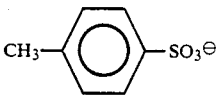
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
-continued
W-4
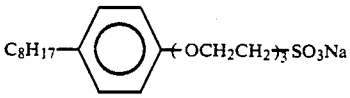
W-5
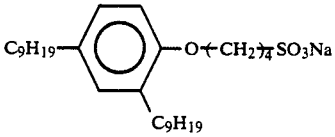
W-6
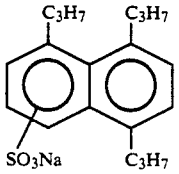
W-7
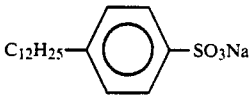
P-1
$\text{-}(CH_2{-}CH)_n\text{-}$ $CONHC_4H_9(t)$
M-1
$\text{-}(CH_2{-}CH)_n\text{-}$ $CONHC_4H_9$
F-1
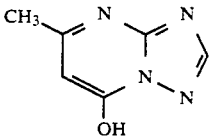
F-2
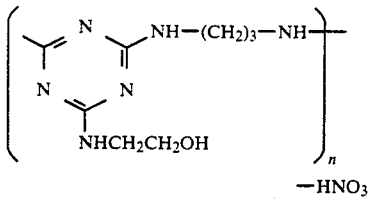
F-3
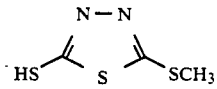
F-4
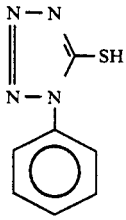

-continued

F-5

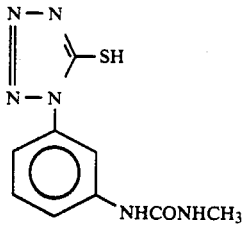

F-6

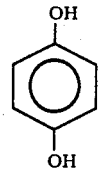

-continued

F-7

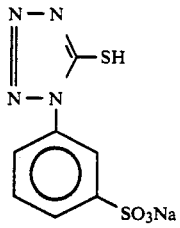

F-8

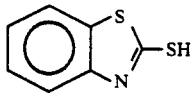

| | Emulsion | Average Grain Size (μm) | Variation Coefficient (%) | AgI Content (%) |
|---|---|---|---|---|
| A | Mono-disperse tetradecahedral grains | 0.25 | 15 | 3.7 |
| B | Mono-disperse cubic internal latent image type grains | 0.30 | 10 | 3.3 |
| C | Mono-disperse tetradecahedral grains | 0.30 | 14 | 5.0 |
| D | Poly-disperse twinned crystal grains | 0.60 | 25 | 2.0 |
| E | Mono-disperse cubic grains | 0.17 | 13 | 4.0 |
| F | Mono-disperse cubic grains | 0.20 | 15 | 4.0 |
| G | Mono-disperse cubic internal latent image type grains | 0.25 | 11 | 3.5 |
| H | Mono-disperse cubic internal latent image type grains | 0.30 | 9 | 3.5 |
| I | Poly-disperse tabular grains, average aspect ratio 4.0 | 0.80 | 28 | 1.5 |
| J | Poly-disperse tetradecahedral grains | 0.31 | 25 | 4.0 |
| K | Poly-disperse tetadecahedral grains | 0.36 | 23 | 4.0 |
| L | Poly-disperse cubic internal latent image type grains | 0.46 | 22 | 3.5 |
| M | Poly-disperse cubic grains | 0.53 | 25 | 4.0 |
| N | Poly-disperse tabular grains, average aspect ratio 7.0 | 1.00 | 28 | 1.3 |

Spectral Sensitization of Emulsions A to N

| Emulsion | Sensitizing Dye Added | Amount Added per Mol Silver Halide (g) | Time At Which Sensitizing Dye Was Added |
|---|---|---|---|
| A | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately before start of chemical sensitization |
| | S-2 | 0.25 | Immediately before start of chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |
| H | S-3 | 0.2 | During grain formation |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-6 | 0.2 | During grain formation |
| | S-5 | 0.05 | During grain formation |
| K | S-6 | 0.2 | Immediately before start of chemical sensitization |
| | S-5 | 0.05 | Immediately before start of chemical sensitization |
| L | S-6 | 0.22 | Immediately after the end of grain formation |
| | S-5 | 0.06 | Immediately after the end of grain formation |
| M | S-6 | 0.15 | Immediately before start of chemical sensitization |
| | S-5 | 0.04 | Immediately before start of chemical sensitization |

-continued

| Spectral Sensitization of Emulsions A to N | | | |
|---|---|---|---|
| Emulsion | Sensitizing Dye Added | Amount Added per Mol Silver Halide (g) | Time At Which Sensitizing Dye Was Added |
| N | S-6 | 0.22 | Immediately after the end of grain formation |
| | S-5 | 0.06 | Immediately after the end of grain formation |

Next, samples 102 to 109 were prepared in which the yellow couplers in the fifteenth to seventeenth layers were replaced with an equimolar amount with respect to the total number of mol in each layer of the yellow couplers shown in table 1. In samples 103 to 109, the emulsions J to L in the fifteenth layer were replaced with an equimolar amount of the emulsions O to P indicated below, respectively, the emulsions L and M in the sixteenth layer were similarly replaced with emulsions Q and R, and emulsion N in the seventeenth layer was similarly replaced with emulsion S.

Moreover, the spectral sensitization of the emulsions O to S was carried out in the same way as for the corresponding emulsions J to N.

| Emulsion | Average Grain Size (μm) | Variation Coefficient (%) | AgI Content (%) |
|---|---|---|---|
| O Mono-disperse tetra-decahedral grains | 0.30 | 15 | 4.0 |
| P Mono-disperse teta-decahedral grains | 0.37 | 14 | 4.0 |
| Q Mono-disperse cubic internal latent image type grains | 0.46 | 14 | 3.5 |
| R Mono-disperse cubic grains | 0.55 | 13 | 4.0 |
| S Mono-disperse tabular grains, average aspect ratio 7.0 | 1.00 | 15 | 1.3 |

Samples 101 to 109 which had been obtained in this way were assessed in terms of the graininess of the yellow image using the general RMS (root mean square) method. The assessment of graininess with the RMS method is well known to those in the art and industry and it has been described in a paper entitled "RMS Granularity; Determination of Just-Noticeable Differences" in *Photographic Science and Engineering*, volume 19, number 4 (1975), pages 235 to 238. Moreover, a measuring aperture of 48 μm was employed. Furthermore, the spectral absorption of the yellow image was also measured.

Moreover, the processed samples were stored for 7 days under conditions of 80° C., 70% RH and the colored image fastness was assessed by obtaining the fractional change in the maximum yellow color density.

The results obtained are shown in table 1.

Moreover, the development process was as outlined below.

| Processing Operations | | | | |
|---|---|---|---|---|
| Processing Operation | Time | Temp. | Tank Capacity | Replenishment Rate |
| Black & White Development | 6 min. | 38° C. | 12 l | 2.2 l/m$^2$ |
| First Water Wash | 2 min. | 38° C. | 4 l | 7.5 l/m$^2$ |
| Reversal | 2 min. | 38° C. | 4 l | 1.1 l/m$^2$ |
| Color | 6 min. | 38° C. | 12 l | 2.2 l/m$^2$ |

-continued

| Processing Operations | | | | |
|---|---|---|---|---|
| Processing Operation | Time | Temp. | Tank Capacity | Replenishment Rate |
| Development Conditioning | 2 min. | 38° C. | 4 l | 1.1 l/m$^2$ |
| Bleaching | 6 min. | 38° C. | 12 l | 0.22 l/m$^2$ |
| Fixing | 4 min. | 38° C. | 8 l | 1.1 l/m$^2$ |
| Second Water Wash | 4 min. | 38° C. | 8 l | 7.5 l/m$^2$ |
| Stabilization | 1 min. | 25° C. | 2 l | 1.1 l/m$^2$ |

The composition of each processing bath was as indicated below.

| Black and White Developer | | |
|---|---|---|
| | Parent Bath | Replenisher |
| Pentasodium nitrilo-N,N,N-trimethylenephosphonate | 2.0 grams | 2.0 grams |
| Sodium sulfite | 30 grams | 30 grams |
| Potassium hydroquinone monosulfonic acid | 20 grams | 20 grams |
| Potassium carbonate | 33 grams | 33 grams |
| 1-Phenyl-4-methyl-4-hydroxy-methyl-3-pyrazolidone | 2.0 grams | 2.0 grams |
| Potassium bromide | 2.5 grams | 1.4 grams |
| Potassium thiocyanate | 1.2 grams | 1.2 grams |
| Potassium iodide | 2.0 mg | — |
| Water to make | 1,000 ml | 1,000 ml |
| pH | 9.60 | 9.60 |

The pH was adjusted with hydrochloric acid or potassium hydroxide.

| Reversal Bath | | |
|---|---|---|
| | Tank Solution | Replenisher |
| Pentasodium nitrilo-N,N,N-trimethylenephosphonic acid | 3.0 grams | Same as the tank Solution |
| Stannous chloride, di-hydrate | 1.0 gram | |
| p-Aminophenol | 0.1 gram | |
| Sodium hydroxide | 8 grams | |
| Glacial acetic acid | 15 ml | |
| Water to make up to | 1,000 ml | |
| pH | 6.00 | |

The pH was adjusted with hydrochloric acid or sodium hydroxide.

| Color Developer | | |
|---|---|---|
| | Tank Solution | Replenisher |
| Pentasodium nitrilo-N,N,N-trimethylenephosphonic acid | 2.0 grams | 2.0 grams |
| Sodium sulfite | 7.0 grams | 7.0 grams |
| Tri-sodium phosphate, dodeca-hydrate | 36 grams | 36 grams |
| Potassium bromide | 1.0 gram | — |

-continued

| Color Developer | Tank Solution | Replenisher |
|---|---|---|
| Potassium iodide | 90 mg | — |
| Sodium hydroxide | 3.0 grams | 3.0 grams |
| Citrazinic acid | 1.5 grams | 1.5 grams |
| N-Ethyl-(β-methanesulfonamidoethyl)-3-methyl-4-aminoaniline sulfate | 11 grams | 11 grams |
| 3,6-Dithia-1,8-octanediol | 1.0 gram | 1.0 gram |
| Water to make | 1,000 ml | 1,000 ml |
| pH | 11.80 | 12.00 |

The pH was adjusted with hydrochloric acid or potassium hydroxide.

| Conditioner | Tank Solution | Replenisher |
|---|---|---|
| Disodium ethylenediaminetetraacetate, di-hydrate | 8.0 grams | Same as the Tank Solution |
| Sodium sulfite | 12 grams | |
| 1-Thioglycerine sorbitan ester | 0.1 gram | |
| Water to make | 1,000 ml | |
| pH | 6.20 | |

The pH was adjusted with hydrochloric acid or sodium hydroxide.

| Bleach | Tank Solution | Replenisher |
|---|---|---|
| Ethylenediaminetetraacetic acid, di-sodium salt, di-hydrate | 2.0 grams | 4.0 grams |
| Ethylenediaminetetraacetic acid, ferric ammonium salt, di-hydrate | 120 grams | 240 grams |
| Potassium bromide | 100 grams | 200 grams |
| Ammonium nitrate | 10 grams | 20 grams |
| Water to make up to | 1,000 ml | 1,000 ml |
| pH | 5.70 | 5.50 |

The pH was adjusted with hydrochloric acid or sodium hydroxide.

| Fixer | Tank Solution | Replenisher |
|---|---|---|
| Ammonium thiosulfate | 8.0 grams | Same as the Tank Solution |
| Sodium sulfite | 5.0 grams | |
| Sodium bisulfite | 5.0 grams | |
| Water to make | 1,000 ml | |
| pH | 6.60 | |

The pH was adjusted with hydrochloric acid or aqueous ammonia.

| Stabilizer | Tank Solution | Replenisher |
|---|---|---|
| Formalin (37%) | 5.0 ml | Same as the Tank Solution |
| Polyoxyethylene p-monononylphenylether (average degree of polymerization 10) | 0.5 ml | |
| Water to make | 1,000 ml | |
| pH | Not Adjusted | |

It is clear from table 1 below that the samples in accordance with the present invention (samples 103 to 109) had good graininess, were good with respect to their spectral absorption characteristics and in terms of the cut-off in the absorption on the long wavelength side and, moreover, they had excellent color image fastness.

TABLE 1

| Sample No. | Comment | Yellow Coupler 15th Layer | 16th Layer | 17th Layer | RMS*1 | Spectral Absorption Characteristics*2 | Colored Image Storage Props.*3 |
|---|---|---|---|---|---|---|---|
| 101 | Comp. Ex. | C-5, C-10 | C-5, C-6 C-10 | C-6, C-10 | 0.012 | 0.39 | 7.3 |
| 102 | Comp. Ex. | Y-7 | Y-2 | Y-29 | 0.019 | 0.30 | 1.1 |
| 103 | Invention | Y-7 | Y-2 | Y-29 | 0.013 | 0.30 | 1.1 |
| 104 | Invention | Y-7 | Y-16 | Y-28 | 0.012 | 0.29 | 1.0 |
| 105 | Invention | Y-30 | Y-34 | Y-5 | 0.013 | 0.31 | 1.2 |
| 106 | Invention | Y-9 | Y-52 | Y-42 | 0.011 | 0.31 | 1.2 |
| 107 | Invention | Y-29 | Y-8 | Y-30 | 0.011 | 0.31 | 1.4 |
| 108 | Invention | Y-37 | Y-12 | Y-7 | 0.012 | 0.29 | 1.0 |
| 109 | Invention | Y-24 | Y-9 | Y-16 | 0.013 | 0.32 | 1.0 |

*1The value at density (fog + 0.5) is shown.
*2The ratio of density at λmax + 50 nm with the density at λmax is shown: (D λmax + 50 nm)/(D λmax).
*3The fractional fall in the maximum color density after storage for 7 days at 80° C., 70% RH is shown as a percentage.

EXAMPLE 2

Samples 201 to 209 are prepared in just the same way as samples 101 to 109 except that the yellow couplers in the fifteenth to seventeenth layers in samples 101 to 109 prepared in example 1 are added using the high boiling point organic solvent Oil-2.

At this time the amount of Oil-2 added is 0.5 times (by weight) the amount of yellow coupler in each layer.

On repeating example 1 with the samples 201 to 209 obtained in this way, similar results to those in example 1 are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising a support having thereon at least one silver halide emulsion layer, wherein a yellow dye forming coupler which is represented by formula (1) indicated below and/or a yellow dye forming coupler which can be represented by the formula (2) indicated below are included in said silver halide emulsion layer, and the size distribution of the silver halide grains in said silver halide emulsion layer is mono-disperse:

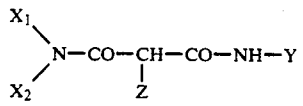

(1)

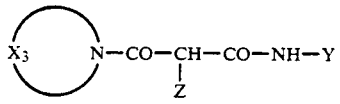

(2)

wherein $X_1$ and $X_2$ each represent an alkyl group, an aryl group or a heterocyclic group, $X_3$ represents an organic residual group which, together with >N—, forms a nitrogen containing heterocyclic group, Y represents an aryl group or a heterocyclic group, and Z represents a non-photographically useful group which is released when the coupler represented by said formulae (1) and (2) reacts with the oxidized form of the developing agent.

2. The silver halide color photographic photosensitive material of claim 1, wherein $X_1$ and $X_2$ represent linear chain, branched, cyclic, saturated, unsaturated, substituted or unsubstituted alkyl groups which have from 1 to 30 carbon atoms.

3. The silver halide color photographic photosensitive material of claim 1, wherein $X_1$, $X_2$ and Y represent three- to twelve- membered, saturated or unsaturated, substituted or unsubstituted, single ring or condensed ring heterocyclic groups which contain at least one nitrogen atom, oxygen atom or sulfur atom as a hetero atom, and which have from 1 to 20 carbon atoms.

4. The silver halide color photographic photosensitive material of claim 1, wherein $X_1$ and $X_2$ represent substituted or unsubstituted aryl groups which have from 6 to 20 carbon atoms.

5. The silver halide color photographic photosensitive material of claim 1, wherein $X_3$ represents a nitrogen containing heterocyclic group which is formed together with >N—, and the heterocyclic group is a three- to six- membered, substituted or unsubstituted, saturated or unsaturated, single ring or condensed ring heterocyclic gorup which contains oxygen, sulfur atoms or nitrogen atoms as hetero atoms, and which has from 1 to 20 carbon atoms.

6. The silver halide color photographic photosensitive material of claim 1, wherein when the $X_1$ and $X_2$ represent alkyl groups, aryl groups or heterocyclic groups which have substituent groups, and when $X_3$ is such that the nitrogen containing heterocyclic group which is formed together with >N— has substituent groups, the substituent groups are selected from the group consisting of alkoxy groups, halogen atoms, alkoxycarbonyl groups, acyloxy groups, acylamino groups, sulfonyl groups, carbamoyl groups, sulfamoyl groups, sulfonamido groups, nitro group, alkyl groups and aryl groups.

7. The silver halide color photographic photosensitive material of claim 1, wherein Y represents a substituted or unsubstituted aryl group which has from 6 to 20 carbon atoms.

8. The silver halide color photographic photosensitive material of claim 1, wherein when Y represents a substituted aryl group or a substituted heterocyclic group, the substituent groups are selected from the group consisting of halogen atoms, alkoxycarbonyl groups, sulfamoyl groups, carbamoyl groups, sulfonyl groups, N-sulfonyl-sulfamoyl groups, N-acylsulfamoyl groups, alkoxy groups, acylamino groups, N-sulfonylcarbamoyl groups, sulfonamido groups and alkyl groups.

9. The silver halide color photographic photosensitive material of claim 1, wherein Y is a phenyl group which has at least one substituent group in an ortho position.

10. The silver halide color photographic photosensitive material of claim 1, wherein $X_1$ is an alkyl group which has from 1 to 10 carbon atoms.

11. The silver halide color photographic photosensitive material of claim 1, wherein Z is a five- or six-membered nitrogen containing heterocyclic group which is bonded to the coupling position by a nitrogen atom, an aromatic oxy group, a five- or six- membered heterocyclic oxy group or a five- or six- membered heterocyclic thio group.

12. The silver halide color photographic photosensitive material of claim 1, wherein couplers of formulae (1) and (2) are represented by the formulae (3), (4) or (5):

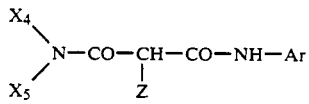

(3)

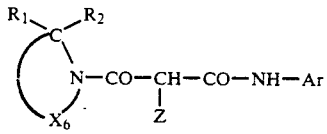

(4)

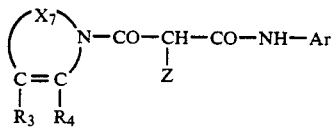

(5)

wherein Z has the same meaning as described in connection with formula (1), $X_4$ represents an alkyl group, $X_5$ represents an alkyl group or an aromatic group, Ar represents a phenyl group which has at least one substituent group in an ortho position, $X_6$ represents an organic residual group which, together with —C($R_1R_2$)—N<, forms a nitrogen containing heterocyclic group (single or condensed ring), $X_7$ represents an organic residual group which, together with —C($R_3$)=C($R_4$)—N<, forms a nitrogen containing heterocyclic group (single or condensed ring), and $R_1$, $R_2$, $R_3$ and $R_4$ represent hydrogen atoms or substituent groups.

13. The silver halide color photographic photosensitive material of claim 12, wherein the couplers are represented by formulae (4) or (5).

14. The silver halide color photographic photosensitive material of claim 12, wherein the couplers represented by formulae (1) to (5) form dimers or larger oligomers by bonding via bivalent groups or groups of higher valency among the groups represented by $X_1$ to $X_7$, Y, Ar, $R_1$ to $R_4$ and Z.

15. The silver halide color photographic photosensitive material of claim 12, wherein the couplers represented by formulae (1) to (5) are nondiffusible.

16. The silver halide color photographic photosensitive material of claim 12, wherein the couplers are added in amounts from $2\times10^{-3}$ to $5\times10^{-1}$ mol, per mol of silver in the emulsion layer.

17. The silver halide color photographic photosensitive material of claim 1, wherein a mono-disperse emulsion is an emulsion in which the variation coefficient of the grain size distribution is not more than 20%.

18. The silver halide color photographic photosensitive material of claim 17, wherein the variation coefficient is below 15%.

19. The silver halide color photographic photosensitive material of claim 1, wherein the silver halide of the mono-disperse emulsion is silver bromide or silver iodobromide, silver iodochloride or silver iodochlorobromide which contain not more than about 30 mol% of silver iodide.

20. The silver halide color photographic photosensitive material of claim 1, wherein the silver halide is silver iodobromide or silver iodochlorobromide which contain from about 2 mol% to about 25 mol% of silver iodide.

21. A silver halide color photographic photosensitive material comprising a support having thereon at least one silver halide emulsion layer, wherein at least one of said silver halide emulsion layers is a yellow dye forming layer containing yellow dye forming couplers consisting essentially of a yellow dye forming coupler represented by formula (1) indicated below and/or a yellow dye forming coupler represented by formula (2) indicated below, and the size distribution of the silver halide grains in said yellow dye forming silver halide emulsion layer is mono-disperse:

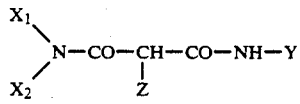

(1)

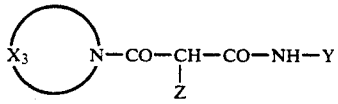

(2)

wherein $X_1$ and $X_2$ each represent an alkyl group, an aryl group or a heterocyclic group, $X_3$ represents an organic residual group which, together with >N—, forms a nitrogen containing heterocyclic group, Y represents an aryl group of a heterocyclic group, and Z represents a non-photographically useful group which is released when the coupler represented by said formulae (1) and (2) reacts with the oxidized form of the developing agent.

* * * * *